US010267184B2

(12) United States Patent
Bowan et al.

(10) Patent No.: US 10,267,184 B2
(45) Date of Patent: Apr. 23, 2019

(54) VALVE NETWORK AND METHOD FOR CONTROLLING PRESSURE WITHIN A SUPERCRITICAL WORKING FLUID CIRCUIT IN A HEAT ENGINE SYSTEM WITH A TURBOPUMP

(71) Applicant: ECHOGEN POWER SYSTEMS, L.L.C., Akron, OH (US)

(72) Inventors: Brett A. Bowan, Copley, OH (US); Michael Louis Vermeersch, Ravenna, OH (US)

(73) Assignee: Echogen Power Systems LLC, Akron, OH (US)

( * ) Notice: Subject to any disclaimer, the term of this patent is extended or adjusted under 35 U.S.C. 154(b) by 162 days.

(21) Appl. No.: 15/523,441

(22) PCT Filed: Oct. 28, 2015

(86) PCT No.: PCT/US2015/057701

§ 371 (c)(1),
(2) Date: May 1, 2017

(87) PCT Pub. No.: WO2016/073245

PCT Pub. Date: May 12, 2016

(65) Prior Publication Data

US 2017/0314420 A1 Nov. 2, 2017

Related U.S. Application Data

(60) Provisional application No. 62/074,182, filed on Nov. 3, 2014.

(51) Int. Cl.
*F01K 13/02* (2006.01)
*F01K 25/02* (2006.01)
(Continued)

(52) U.S. Cl.
CPC ..... *F01K 13/02* (2013.01); *F01K 7/16* (2013.01); *F01K 11/02* (2013.01); *F01K 25/02* (2013.01);
(Continued)

(58) Field of Classification Search
CPC ..... F01K 13/02; F01K 25/08; F25B 11/00; F25B 13/00
See application file for complete search history.

(56) References Cited

U.S. PATENT DOCUMENTS 5,754,613 A * 5/1998 Hashiguchi ..... F01K 23/04 376/378
6,484,490 B1 * 11/2002 Olsen ..... F02C 7/22 60/39.281
(Continued)

*Primary Examiner* — Mark Laurenzi
*Assistant Examiner* — Shafiq Mian
(74) *Attorney, Agent, or Firm* — Nolte Intellectual Property Law Group

(57) ABSTRACT

Aspects of the invention generally provide a heat engine system and a method for activating a turbopump within the heat engine system during a start-up process. The heat engine system utilizes a working fluid circulated within a working fluid circuit for capturing thermal energy. In one exemplary aspect, a start-up process for a turbopump in the heat engine system is provided such that the turbopump achieves self-sustained operation in a supercritical Rankine cycle. Bypass and check valves of a start pump and the turbopump, a drive turbine throttle valve, and other valves, lines, or pumps within the working fluid circuit are controlled during the turbopump start-up process. A process control system may utilize advanced control techniques of the control sequence to provide a successful start-up process of the turbopump without over pressurizing the working fluid circuit or damaging the turbopump via low bearing pressure.

20 Claims, 3 Drawing Sheets

(51) Int. Cl.

| | |
|---|---|
| ***F04D 15/00*** | (2006.01) |
| ***F01K 7/16*** | (2006.01) |
| ***F01K 11/02*** | (2006.01) |
| ***F01K 25/10*** | (2006.01) |

(52) U.S. Cl.
CPC ..... *F01K 25/103* (2013.01); *F04D 15/0011* (2013.01); *F04D 15/0072* (2013.01); *F05D 2260/85* (2013.01)

(56) References Cited

U.S. PATENT DOCUMENTS

| | | | | |
|---|---|---|---|---|
| 6,571,548 | B1 * | 6/2003 | Bronicki | F01K 23/10 60/39.181 |
| 7,841,306 | B2 * | 11/2010 | Myers | F01D 15/10 122/406.5 |
| 8,096,128 | B2 * | 1/2012 | Held | F01K 3/185 60/645 |
| 8,146,360 | B2 * | 4/2012 | Myers | F01D 15/10 60/618 |
| 8,820,083 | B2 * | 9/2014 | Davidson | H02J 4/00 60/671 |
| 2003/0172666 | A1 * | 9/2003 | Matsumoto | F04C 23/001 62/175 |
| 2010/0326076 | A1 * | 12/2010 | Ast | F01K 23/04 60/671 |
| 2011/0048012 | A1 * | 3/2011 | Ernst | F01K 9/003 60/651 |
| 2013/0033037 | A1 * | 2/2013 | Held | F01K 3/185 290/2 |
| 2014/0208750 | A1 * | 7/2014 | Vermeersch | F01K 13/02 60/646 |

* cited by examiner

VALVE NETWORK AND METHOD FOR CONTROLLING PRESSURE WITHIN A SUPERCRITICAL WORKING FLUID CIRCUIT IN A HEAT ENGINE SYSTEM WITH A TURBOPUMP

This application claims benefit of U.S. Prov. Appl. No. 62/074,182, filed on Nov. 3, 2014, the contents of which are hereby incorporated by reference to the extent not inconsistent with the present disclosure.

BACKGROUND

Waste heat is often created as a byproduct of industrial processes where flowing streams of high-temperature liquids, gases, or fluids must be exhausted into the environment or removed in some way in an effort to maintain the operating temperatures of the industrial process equipment. Some industrial processes utilize heat exchanger devices to capture and recycle waste heat back into the process via other process streams. However, the capturing and recycling of waste heat is generally infeasible by industrial processes that utilize high temperatures or have insufficient mass flow or other unfavorable conditions.

Waste heat may be converted into useful energy by a variety of turbine generator or heat engine systems that employ thermodynamic methods, such as Rankine cycles, that are typically steam-based processes that recover and utilize waste heat to generate steam for driving a turbine or other expander connected to a generator. An organic Rankine cycle utilizes a lower boiling-point working fluid, instead of water, during a traditional Rankine cycle. Exemplary lower boiling-point working fluids include hydrocarbons, such as light hydrocarbons (e.g., propane or butane) and halogenated hydrocarbon, such as hydrochlorofluorocarbons (HCFCs) or hydrofluorocarbons (HFCs) (e.g., R245fa).

In addition, the turbines and pumps utilized in turbine generator systems are susceptible to fail due to over-pressurization, as well as, under-pressurization within the fluid systems, especially near the inlets and outlets of the turbines and pumps. If the system inlet pressure decreases to a level in which the working fluid loses energy, then a system pump may be catastrophically damaged by way of cavitation. Generally, once the system pressure becomes uncontrollable, control of the system temperature is also lost. Therefore, the turbines and pumps may also be susceptible to fail due to thermal shock when exposed to substantial and imminent temperature differentials. Such rapid change of temperature generally occurs when the turbine or pump is exposed to a supercritical working fluid. The thermal shock may cause valves, blades, and other parts to crack and result in catastrophic damage to the unit.

A turbine-driven pump, such as a turbopump, may be utilized in an advanced Rankine cycle. Generally, the manner in which the turbine-driven pump is controlled may be quite relevant to the operation and efficiency of the overall thermal cycle process. The control of the turbine-driven pump is often not precise enough to achieve the most efficient or maximum operating conditions without damaging the turbine-driven pump. Also, to increase the efficiency of the overall thermal cycle, the turbine-driven pump may achieve self-sustained operation during the start-up process and maintain such self-sustained operation during the thermal cycle. However, the turbine-driven pump often over pressurizes or under pressurizes segments of the working fluid circuit when attempting to obtain or maintain self-sustained operation, which in turn, may lead to the damaging of the turbomachinery or other components within the system.

Therefore, there is a need for a heat engine system and a method for activating and sustaining a turbopump within the heat engine system, whereby the turbopump achieves self-sustained operation in a supercritical cycle without over pressurizing the working fluid circuit during a start-up process and maintains self-sustained operation while maximizing the efficiency of the heat engine system to generate energy.

SUMMARY

Embodiments of the invention generally provide a heat engine system and a method for activating a turbopump within the heat engine system during a start-up process and sustaining the turbopump during efficient operation of the heat engine system. The heat engine system generates mechanical energy and/or electrical energy from thermal energy, such as a heat source (e.g., a waste heat stream). The heat engine system utilizes a working fluid in a supercritical state (e.g., sc-$CO_2$) and/or a subcritical state (e.g., sub-$CO_2$) contained within a working fluid circuit for capturing or otherwise absorbing thermal energy of the waste heat stream with one or more heat exchangers. The thermal energy is transformed to mechanical energy by a power turbine and/or a drive turbine and subsequently transformed to electrical energy by the power generator coupled to the power turbine. The heat engine system contains several integrated subsystems managed by a process control system for maximizing the efficiency of the heat engine system while generating electricity.

In one exemplary embodiment, the heat engine system contains a process control system operatively connected to the working fluid circuit and may be configured to adjust a turbopump bypass valve and a start pump bypass valve while providing a turbopump discharge pressure at a greater value than a start pump discharge pressure. A control algorithm may be configured to calculate and adjust the valve positions for the turbopump bypass valve and the start pump bypass valve, such to provide the turbopump discharge pressure at a greater value than the start pump discharge pressure. In another exemplary embodiment, the heat engine system contains a turbopump check valve and a start pump check valve. The turbopump check valve may be configured to adjust from a closed-position to an opened-position at a predetermined pressure, the start pump check valve may be configured to adjust from an opened-position to a closed-position at the predetermined pressure, and the predetermined pressure may be about 2,200 psig or greater. In another exemplary embodiment, the heat engine system contains an inventory supply line, an inventory supply valve, and a transfer pump that are configured to pressurize the inventory supply line and to flow the working fluid from a storage tank, through the inventory supply line, and into the working fluid circuit.

In another embodiment described herein, a method for activating a turbopump within a heat engine system during a start-up process is provided and includes circulating a working fluid (e.g., sc-$CO_2$) within the working fluid circuit, transferring thermal energy from the heat source stream to the working fluid within the high pressure side. The method also includes pressurizing a section of the inventory supply line with the transfer pump while maintaining the inventory supply valve in a closed-position. The inventory supply line may be fluidly coupled to and between a storage tank (e.g., the mass control tank) and the working fluid circuit. The method further includes flowing the working fluid from the high pressure side into a drive turbine of the turbopump, wherein the working fluid has an inlet pressure measured near an inlet of the drive turbine, and flowing the working fluid from a pump portion of the turbopump into the high pressure side, wherein the working fluid as a turbopump discharge pressure measured near an outlet of the pump portion of the turbopump.

The method also includes detecting a desirable pressure within the section of the inventory supply line and detecting the turbopump discharge pressure equal to or greater than the inlet pressure; subsequently, adjusting the inventory supply valve to an opened-position, providing a drive turbine throttle valve in an opened-position, and flowing the working fluid through the inventory supply line, through the working fluid circuit, and into the drive turbine, wherein the drive turbine throttle valve is fluidly coupled to the working fluid circuit upstream of the drive turbine.

The method further includes increasing the turbopump discharge pressure during an acceleration process of the turbopump by the following: (a) switching a process controller for a turbopump bypass valve from an automatic mode setting to a manual mode setting, switching a process controller for a start pump bypass valve from an automatic mode setting to a manual mode setting, and monitoring the turbopump discharge pressure via a process control system operatively connected to the working fluid circuit; (b) detecting an undesirable value of the turbopump discharge pressure via the process control system, wherein the undesirable value is less than a predetermined threshold value of the turbopump discharge pressure; (c) adjusting the turbopump bypass valve and the start pump bypass valve with the process control system to increase the turbopump discharge pressure; (d) detecting a desirable value of the turbopump discharge pressure via the process control system, wherein the desirable value is equal to or greater than the predetermined threshold value of the turbopump discharge pressure; and (e) switching the process controllers for the turbopump bypass valve and start pump bypass valve from the manual mode settings to the automatic mode settings.

In another embodiment, the method further includes circulating the working fluid within the working fluid circuit by a start pump prior to adjusting the inventory supply valve to the opened-position. Once the turbopump discharge pressure is greater than a start pump discharge pressure, then the method may include opening a turbopump check valve and closing a start pump check valve, wherein the turbopump check valve is fluidly coupled to the working fluid circuit downstream of the pump portion of the turbopump and the start pump check valve is fluidly coupled to the working fluid circuit downstream of a pump portion of the start pump. In some examples, the method includes activating adaptive tuning on the process controller of the turbopump bypass valve to change response properties for maintaining a specified setpoint.

BRIEF DESCRIPTION OF THE DRAWINGS

Embodiments of the present disclosure are best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Embodiments of the invention generally provide a heat engine system and a method for activating a turbopump within the heat engine system during a start-up process. The heat engine system may be utilized to generate mechanical energy and/or electrical energy from thermal energy, such as a heat source (e.g., a waste heat stream). The heat engine system contains a working fluid within a working fluid circuit that has a low pressure side and a high pressure side. The heat engine system may utilize the working fluid in a supercritical state (e.g., sc-$CO_2$) and/or a subcritical state (e.g., sub-$CO_2$) contained within the working fluid circuit for capturing or otherwise absorbing thermal energy of the waste heat stream with one or more heat exchangers.

In one exemplary embodiment, a start-up process for a turbopump in the heat engine system is provided such that the turbopump achieves self-sustained operation in a supercritical Rankine cycle. The start-up process for the turbopump may utilize a start pump bypass valve, a turbopump bypass valve, a drive turbine throttle valve, a start pump check valve, a turbopump check valve, as well as other valves, lines, or pumps within the working fluid circuit. A process control system may utilize advanced control techniques of feedforward, adaptive tuning, sliding mode, multivariable control, and other techniques of the control sequence to provide a successful start-up process of the turbopump without over pressurizing the high pressure side of the working fluid circuit or damaging the turbopump via low bearing pressure.

Figure 1:
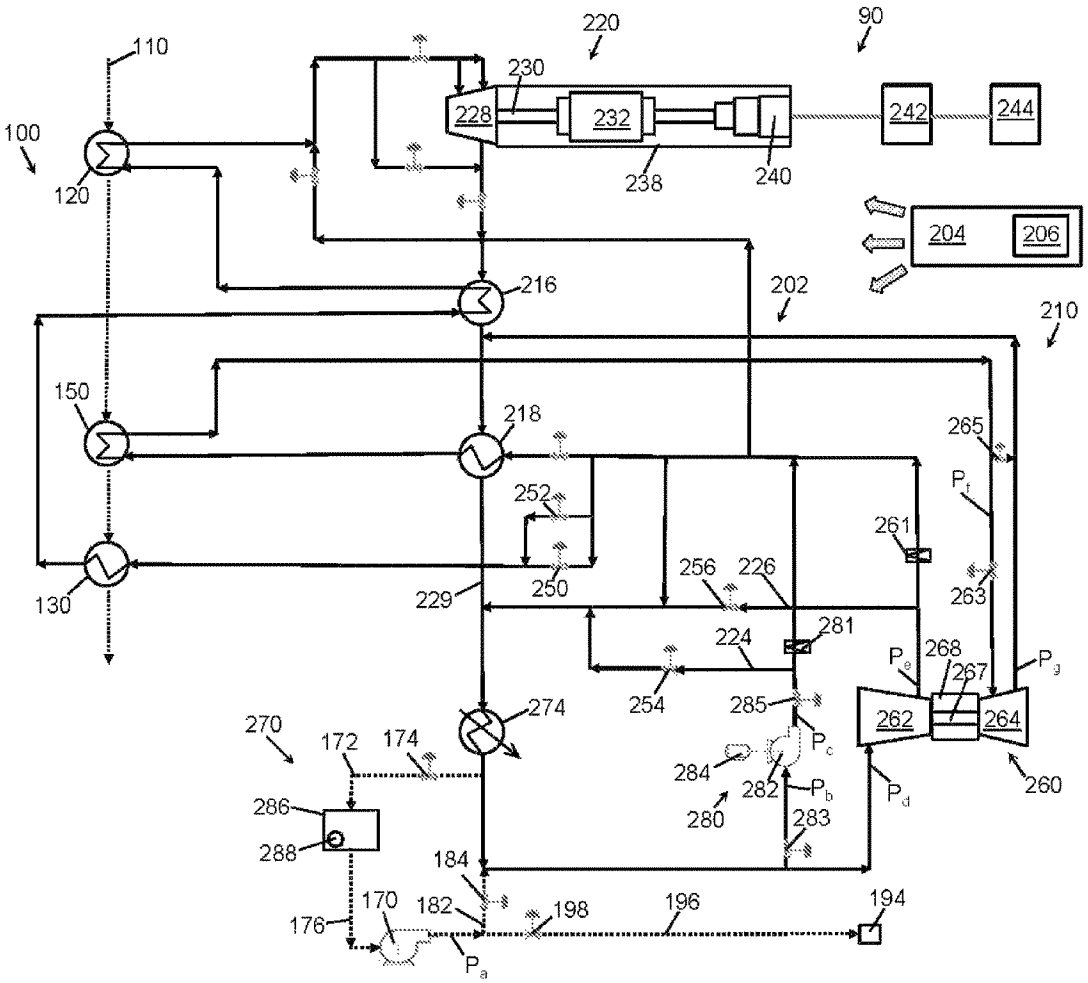
FIG. 1 depicts an exemplary heat engine system, according to one or more embodiments disclosed herein.
Figure 2:
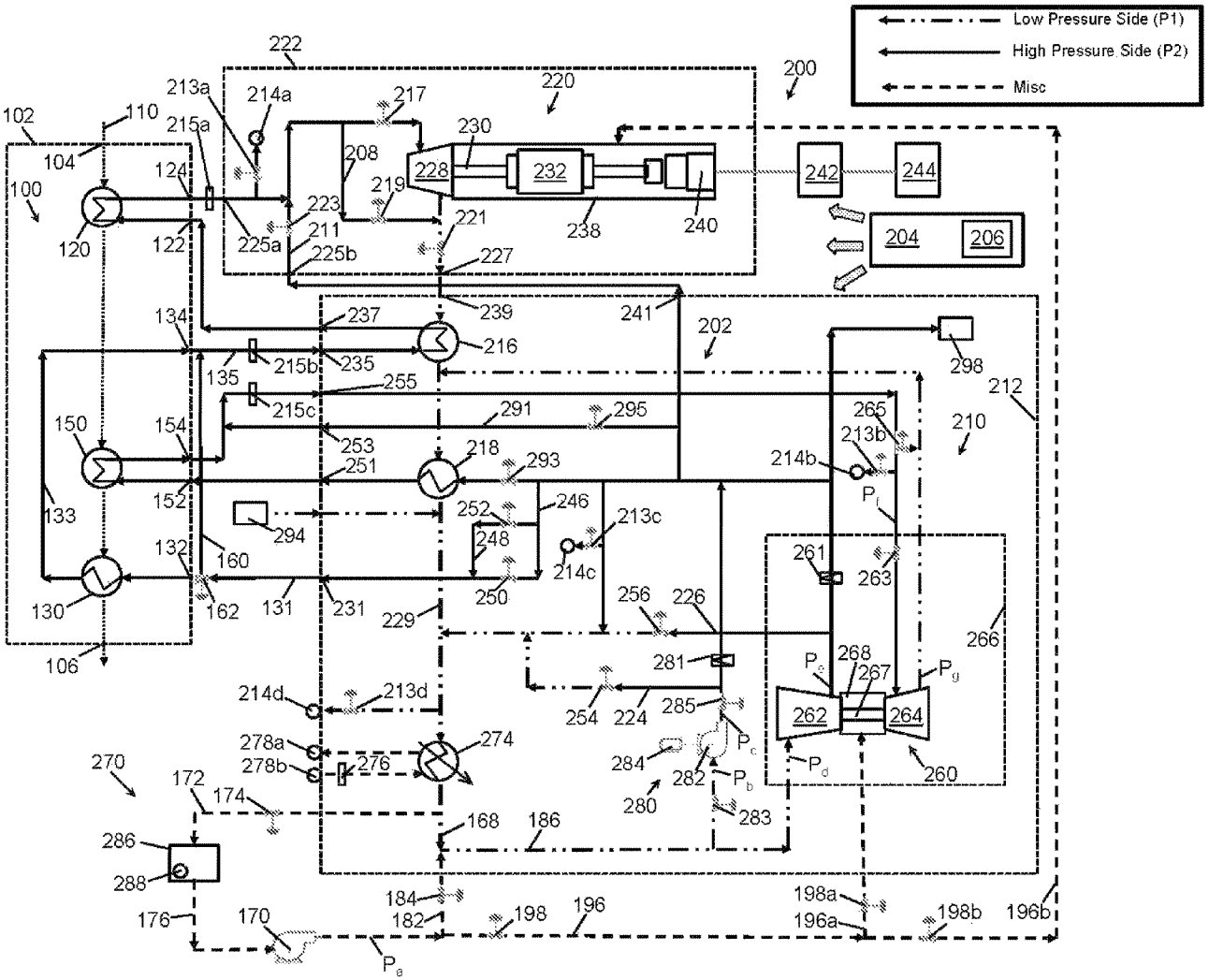
FIG. 2 depicts another exemplary heat engine system, according to one or more embodiments disclosed herein.

FIG. 1 depicts an exemplary heat engine system 90, as described in one or more embodiments herein and FIG. 2 depicts another exemplary heat engine system 200, as described in one or more embodiments herein. The heat engine system 90, 200 may be referred to as a thermal engine system, an electrical generation system, a waste heat or other heat recovery system, and/or a thermal to electrical energy system, as described in one or more embodiments herein. The heat engine system 90, 200 is generally configured to encompass one or more elements of a Rankine cycle, a derivative of a Rankine cycle, or another thermodynamic cycle for generating electrical energy from a wide range of thermal sources.

The heat engine system 90, 200 further contains a waste heat system 100 and a power generation system 220 coupled to and in thermal communication with each other via a working fluid circuit 202. The working fluid circuit 202 contains the working fluid and has a low pressure side and a high pressure side. The low and high pressure sides of the working fluid circuit 202 are further discussed below and distinctly illustrated in FIG. 2. In many examples, the working fluid contained in the working fluid circuit 202 is carbon dioxide or substantially contains carbon dioxide and may be in a supercritical state (e.g., sc-$CO_2$) and/or a subcritical state (e.g., sub-$CO_2$). In one or more examples, the working fluid disposed within the high pressure side of the working fluid circuit 202 contains carbon dioxide in a supercritical state and the working fluid disposed within the low pressure side of the working fluid circuit 202 contains carbon dioxide in a subcritical state.

The heat engine system 90, 200 further contains at least one heat exchanger, such as heat exchangers 120, 130, and 150, fluidly coupled to and in thermal communication with the high pressure side of the working fluid circuit 202. The heat exchangers 120, 130, and 150 may be configured to be fluidly coupled to and in thermal communication with a heat source stream 110 that flows through the waste heat system 100. Therefore, the heat exchangers 120, 130, and 150 may be configured to transfer thermal energy from the heat source stream 110 to the working fluid within the high pressure side of the working fluid circuit 202. The thermal energy may be absorbed by the working fluid to form heated and pressurized working fluid that may be circulated through the working fluid circuit 202. The heated and pressurized working fluid may transfer the captured energy to various expanders and heat exchangers which utilize and transform the captured energy to useful mechanical and/or electrical energy.

The heat engine system 90, 200 also generally contains at least one recuperator, such as recuperators 216 and 218, and at least one condenser or cooler, such as a condenser 274. Each of the recuperators 216 and 218 may independently be fluidly coupled to the working fluid circuit 202 and may be configured to transfer thermal energy from the working fluid within the low pressure side to the working fluid within the high pressure side of the working fluid circuit 202. The condenser 274 may be in thermal communication with the working fluid circuit 202 and may be configured to remove thermal energy from the working fluid in the low pressure side of the working fluid circuit 202.

The heat engine system 90, 200 also contains at least one expander, such as a power turbine 228, and a driveshaft 230 within the power generation system 220. The power turbine 228 may be fluidly coupled to the working fluid circuit 202 and disposed between the low and high pressure sides of the working fluid circuit 202. The power turbine 228 may be configured to convert a pressure drop in the working fluid between the high and low pressure sides of the working fluid circuit 202 to mechanical energy. The driveshaft 230 is coupled to the power turbine 228 and may be configured to drive a device (e.g., a generator/alternator or a pump/compressor) with the mechanical energy generated by the power turbine 228. The power turbine 228 is generally coupled to one or more power devices, such as a power generator 240, by the driveshaft 230. The power generator 240 or another type of power device is generally configured to convert the mechanical energy from the power turbine 228 into electrical energy. The power generator 240 or another type of power device may be selected from a generator, an alternator, a motor, derivatives thereof, or combinations thereof. In other exemplary configurations, although not illustrated, the power turbine 228 and/or another expander or turbine may be coupled to a pump, a compressor, or other device driven by the generated mechanical energy. In one exemplary embodiment, a power outlet 242 electrically coupled to the power generator 240 and may be configured to transfer the electrical energy from the power generator 240 to an electrical grid. The power generation system 220 generally contains a gearbox 232 coupled between the power turbine 228 and the power generator 240 via the driveshaft 230, either as a single shaft or multiple connected shafts.

The heat engine system 90, 200 generally contains several pumps, such as a turbopump 260 and a start pump 280, fluidly coupled between the low pressure side and the high pressure side of the working fluid circuit 202. The start pump 280 may generally be an electric motorized pump or a mechanical motorized pump, and may be a variable frequency driven pump. The start pump 280 may be configured to circulate and/or pressurize the working fluid within the working fluid circuit 202. The start pump 280 may contain a pump portion 282 and a motor-drive portion 284, as depicted in FIGS. 1 and 2. The pump portion 282 of the start pump 280 may be fluidly coupled to the working fluid circuit 202 and disposed between the low and high pressure sides of the working fluid circuit 202. The turbopump 260 may also be fluidly coupled to the working fluid circuit 202 and disposed between the low and high pressure sides of the working fluid circuit 202. The turbopump 260 may also be configured to circulate and/or pressurize the working fluid within the working fluid circuit 202.

The turbopump 260 generally contains a drive turbine 264 coupled to and may be configured to drive or otherwise power a pump portion 262 via a driveshaft 267, as depicted in FIGS. 1 and 2. The pump portion 262 of the turbopump 260 may be disposed between the high pressure side and the low pressure side of the working fluid circuit 202. The pump inlet on the pump portion 262 is generally disposed in the low pressure side and the pump outlet on the pump portion 262 is generally disposed in the high pressure side. The drive turbine 264 of the turbopump 260 may be fluidly coupled to the working fluid circuit 202 downstream of the heat exchanger 150 and the pump portion 262 of the turbopump 260 may be fluidly coupled to the working fluid circuit 202 upstream of the heat exchanger 120. In some embodiments, a secondary heat exchanger, such as the heat exchanger 150, may be fluidly coupled to and in thermal communication with the heat source stream 110 and independently fluidly coupled to and in thermal communication with the working fluid in the working fluid circuit 202. The thermal energy transported by the working fluid exiting the heat exchanger 150 may be utilized to move or otherwise power the drive turbine 264.

In one or more embodiments, the working fluid circuit 202 provides a bypass flowpath for the start pump 280 via a start pump bypass line 224 and a start pump bypass valve 254, as well as a bypass flowpath for the turbopump 260 via a turbopump bypass line 226 and a turbopump bypass valve 256. The start pump bypass line 224 and the start pump bypass valve 254 may be fluidly coupled to the working fluid circuit 202 and disposed downstream of the pump portion 282 of the start pump 280. Therefore, one end of the start pump bypass line 224 may be fluidly coupled to an outlet of the pump portion 282 and the other end of the start pump bypass line 224 may be fluidly coupled to a fluid line 229. Also, the turbopump bypass valve 256 may be fluidly coupled to the working fluid circuit 202 and disposed downstream of the pump portion 262 of the turbopump 260. As such, one end of the turbopump bypass line 226 may be fluidly coupled to an outlet of the pump portion 262 and the other end of the turbopump bypass line 226 may be fluidly coupled to the start pump bypass line 224. In some configurations, the start pump bypass line 224 and the turbopump bypass line 226 merge together as a single line upstream of coupling to the fluid line 229. The fluid line 229 extends between and may be fluidly coupled to the recuperator 218 and the condenser 274. The start pump bypass valve 254 may be disposed along the start pump bypass line 224 and may be fluidly coupled between the low pressure side and the high pressure side of the working fluid circuit 202 when in a closed-position. Similarly, the turbopump bypass valve 256 may be disposed along the turbopump bypass line 226 and may be fluidly coupled between the low pressure side and the high pressure side of the working fluid circuit 202 when in a closed-position.

The heat engine system 90, 200 also contains a process control system 204 operatively connected to the working fluid circuit 202. The process control system 204 contains a computer system 206 and process operating software that utilize a control algorithm. The process operating software and the control algorithm may be embedded, stored within, or accessed by the computer system 206. The control algorithm contains a governing loop controller. The governing controller is generally utilized to adjust valves throughout the working fluid circuit 202 for controlling the temperature, pressure, flowrate, and/or mass of the working fluid at specified points in the working fluid circuit 202. The governing loop controller may configured to maintain desirable threshold values for various inlet/discharge pressures by modulating, adjusting, or otherwise controlling specified valves. In some exemplary embodiments, the control algorithm may be utilized to control the drive turbine throttle valve 263, the start pump bypass valve 254, the turbopump bypass valve 256, the bearing gas supply valve 198, 198*a*, and 198*b*, as well as other valves, pumps, and sensors within the heat engine system 200.

In some exemplary embodiment, the start pump bypass valve 254 may be configured to control the flow of the working fluid passing into the high pressure side of the working fluid circuit 202 from the start pump 280, the turbopump bypass valve 256 may be configured to control the flow of the working fluid passing into the high pressure side of the working fluid circuit 202 from the pump portion 262, and a drive turbine throttle valve 263 may be configured to control the flow of the working fluid passing into the drive turbine 264. The drive turbine throttle valve 263 may be fluidly coupled to the working fluid circuit 202 upstream of the inlet of the drive turbine 264 of the turbopump 260. The start pump bypass valve 254, the turbopump bypass valve 256, and the drive turbine throttle valve 263 may be independently or simultaneously adjusted or controlled by the process control system 204 during the process methods described herein. In one exemplary embodiment, the governing loop controller may configured to maintain desirable threshold values for various inlet/discharge pressures by modulating, adjusting, or otherwise controlling the start pump bypass valve 254, the turbopump bypass valve 256, and the drive turbine throttle valve 263.

Figure 3:
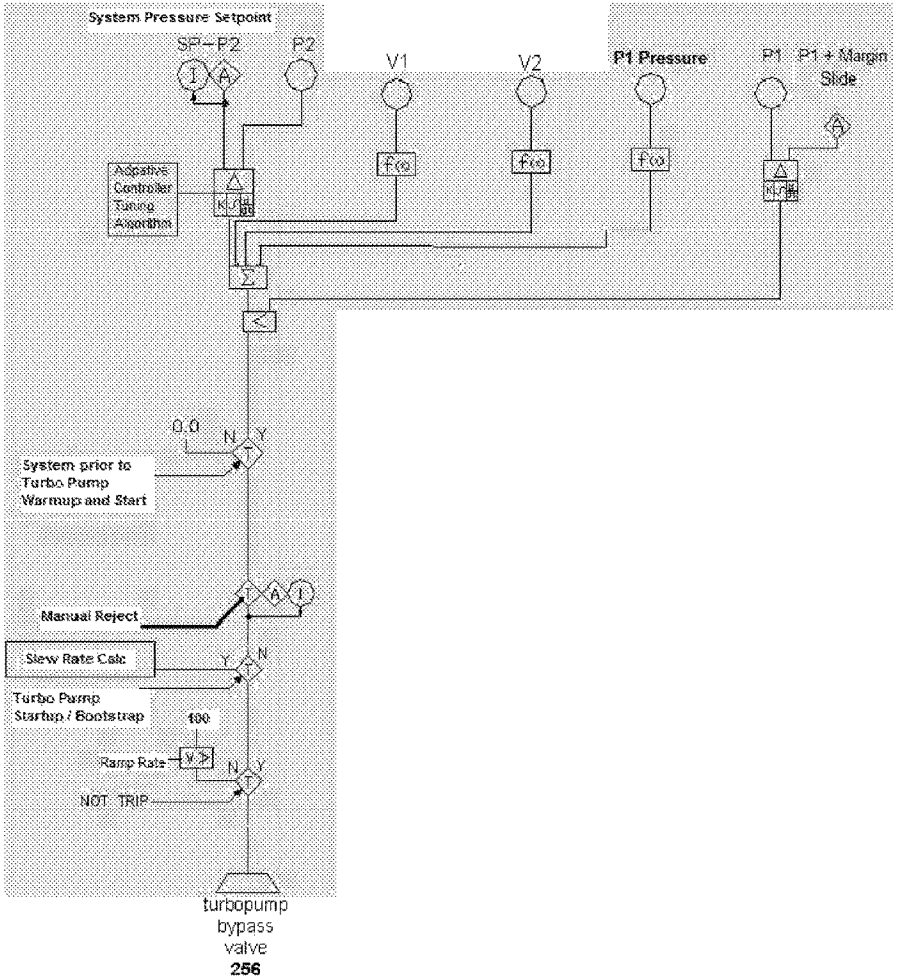
FIG. 3 depicts a schematic diagram of a system controller configured to operate the turbopump bypass valve, according to one or more embodiments disclosed herein.

FIG. 3 depicts a schematic diagram of an exemplary system controller that may be configured to operate the turbopump bypass valve 256, according to one or more embodiments disclosed herein. In exemplary embodiments, the system controller for the turbopump bypass valve 256 may be utilized to control valves V1 and V2, as labeled in FIG. 3. In one exemplary embodiment, the system controller for the turbopump bypass valve 256 may be utilized to control the start pump bypass valve 254 as V1 and the turbopump bypass valve 256 as V2. In another exemplary embodiment, the system controller for the turbopump bypass valve 256 may be utilized to control the drive turbine throttle valve 263 as V1 and the turbopump bypass valve 256 as V2.

In one or more embodiments described herein, FIGS. 1 and 2 illustrate points $P_a$-$P_g$ on the working fluid circuit 202 where various conditions of the working fluid, such as, for example, pressure, temperature, and/or flowrate, may be measured or otherwise achieved at or near the respective point. A discharge pressure ($P_a$) of the transfer pump 170 (also referred to as the transfer pump discharge pressure ($P_a$)) may be achieved and measured downstream of the transfer pump 170 and upstream of the inventory supply valve 184, such as at or near the labeled point $P_a$. An inlet pressure ($P_b$) of the pump portion 282 of the start pump 280 (also referred to as the start pump inlet pressure ($P_b$)) may be achieved and measured downstream of the start pump inlet valve 283 and upstream of the pump portion 282, such as at or near the labeled point $P_b$. A discharge pressure ($P_c$) of the pump portion 282 of the start pump 280 (also referred to as the start pump discharge pressure ($P_c$)) may be achieved and measured downstream of the pump portion 282 and upstream of the start pump outlet valve 285, the start pump bypass valve 254, and/or the start pump check valve 281, such as at or near the labeled point $P_c$. An inlet pressure ($P_d$) of the pump portion 262 of the turbopump 260 (also referred to as the turbopump inlet pressure ($P_d$)) may be achieved and measured downstream of the inventory supply valve 184 and upstream of the pump portion 262, such as at or near the labeled point $P_d$. A discharge pressure ($P_e$) of the pump portion 262 of the turbopump 260 (also referred to as the turbopump discharge pressure ($P_e$)) may be achieved and measured downstream of the pump portion 262 and upstream of the turbopump bypass valve 256 and/or the turbopump check valve 261, such as at or near the labeled point $P_e$. An inlet pressure ($P_f$) of the drive turbine 264 of the turbopump 260 (also referred to as the drive turbine inlet pressure ($P_f$)) may be achieved and measured downstream of the heat exchanger 150 and upstream of the drive turbine 264, such as upstream of the drive turbine throttle valve 263, at or near the labeled point $P_f$, or alternatively, downstream of the drive turbine throttle valve 263 (not shown). A discharge pressure ($P_g$) of the drive turbine 264 of the turbopump 260 (also referred to as the drive turbine discharge pressure ($P_g$)) may be achieved and measured downstream of the drive turbine 264 and upstream of the low pressure side of the recuperator 218, such as upstream of the drive turbine bypass valve 265, at or near the labeled point $P_g$.

In one exemplary embodiment, the process control system 204 may be configured to adjust the turbopump bypass valve 256 and the start pump bypass valve 254 while providing a turbopump discharge pressure ($P_e$) at a greater value than a start pump discharge pressure ($P_c$). The control algorithm may calculate and adjust the valve positions for the turbopump bypass valve 256 and the start pump bypass valve 254, such to provide the turbopump discharge pressure at a greater value than the start pump discharge pressure ($P_e > P_c$). The process control system 204 may utilize advanced control techniques of feedforward, adaptive tuning, sliding mode, multivariable control, and/or other techniques. The control sequence or routine achieves the difficult and complicated task of starting the turbopump 260 without over pressurizing the high pressure side of the working fluid circuit 202 or damaging the turbopump 260 via a low bearing pressure. Therefore, the stable control and operation of the turbopump 260 may be achieved and the desired efficiencies of the heat engines 90, 200 may be obtained by the systems and methods described herein.

In other exemplary embodiments described herein, the heat engine system 90, 200 also contains a turbopump check valve 261 and a start pump check valve 281. The turbopump check valve 261 may be disposed downstream of an outlet of the pump portion 262 of the turbopump 260 and the start pump check valve 281 may be disposed downstream of an outlet of a pump portion 282 of the start pump 280. The turbopump check valve 261 may be configured to adjust from a closed-position to an opened-position at a predetermined pressure and the start pump check valve 281 may be configured to adjust from an opened-position to a closed-position at the predetermined pressure. In some exemplary embodiments, the predetermined pressure may be about 2,200 psig or greater.

In another exemplary embodiment, the heat engine system 90, 200 further contains an inventory supply line 196, an inventory supply valve 198, and a transfer pump 170. The inventory supply line 196 may be fluidly coupled to the low pressure side of the working fluid circuit 202 and may be configured to transfer the working fluid into the working fluid circuit 202. The inventory supply valve 198 may be fluidly coupled to the inventory supply line 196 and may be configured to control the flow of the working fluid passing through the inventory supply line 196. The transfer pump 170 may be fluidly coupled to the inventory supply line 196, configured to pressurize the inventory supply line 196, and may be configured to flow the working fluid through the inventory supply line 196 and into the working fluid circuit 202.

In some exemplary configurations, the inventory supply line 196, the inventory supply valve 198, and the transfer pump 170 are components within a mass management system (MMS) 270 fluidly coupled to the low pressure side of the working fluid circuit 202. The mass management system 270 generally contains a mass control tank 286 that may be fluidly coupled to the low pressure side of the working fluid circuit 202 by the inventory supply line 196 and may be configured to receive, store, and dispense the working fluid. The process control system 204 may be configured to pressurize a section of the inventory supply line 196, such as at or near the point $P_a$ (FIGS. 1 and 2), with the transfer pump 170. Also, the process control system 204 may be configured to adjust the inventory supply valve 198 and the drive turbine throttle valve 263 for transferring the working fluid into the drive turbine 264.

In another embodiment described herein, a method for activating the turbopump 260 within the heat engine system 90, 200 during a start-up process is provided and includes circulating a working fluid (e.g., sc-$CO_2$) within the working fluid circuit 202 and transferring thermal energy from the heat source stream 110 to the working fluid within the high pressure side of the working fluid circuit 202. The method also includes pressurizing a section of the inventory supply line 196, such as at or near the point $P_a$, with the transfer pump 170 while maintaining the inventory supply valve 198 in a closed-position. The inventory supply line 196 may be fluidly coupled to and between a storage tank or vessel (e.g., the mass control tank 286) and the working fluid circuit 202.

The method further includes flowing the working fluid from the high pressure side of the working fluid circuit 202 into the drive turbine 264 of the turbopump 260, such that the working fluid has an drive turbine inlet pressure ($P_f$) measured near an inlet of the drive turbine 264, such as at or near point $P_f$. The method further includes flowing the working fluid from the pump portion 262 of the turbopump 260 into the high pressure side of the working fluid circuit 202, so that the working fluid has a turbopump discharge pressure ($P_e$) measured near an outlet of the pump portion 262 of the turbopump 260, such as at or near point $P_e$. The method also includes detecting a desirable pressure within the section of the inventory supply line 196 and detecting the turbopump discharge pressure ($P_e$) equal to or greater than the drive turbine inlet pressure ($P_f$). Subsequently, the method includes adjusting the inventory supply valve 198 to an opened-position, providing the drive turbine throttle valve 263 in an opened-position, and flowing the working fluid through the inventory supply line 196, through the working fluid circuit 202, and into the drive turbine 264. The drive turbine throttle valve 263 may be fluidly coupled to the working fluid circuit 202 upstream of the drive turbine 264.

The method may further include increasing the turbopump discharge pressure during an acceleration process of the turbopump 260, as described in one or more exemplary embodiments, by the following: (a) switching a process controller for the turbopump bypass valve 256 from an automatic mode setting to a manual mode setting, switching a process controller for the start pump bypass valve 254 from an automatic mode setting to a manual mode setting, and monitoring the turbopump discharge pressure at or near point $P_e$ (FIGS. 1 and 2) via the process control system 204 operatively connected to the working fluid circuit 202; (b) detecting an undesirable value of the turbopump discharge pressure via the process control system 204, wherein the undesirable value is less than a predetermined threshold value of the turbopump discharge pressure; (c) adjusting the turbopump bypass valve 256 and the start pump bypass valve 254 with the process control system 204 to increase the turbopump discharge pressure; (d) detecting a desirable value of the turbopump discharge pressure at or near point $P_e$ via the process control system 204, wherein the desirable value is equal to or greater than the predetermined threshold value of the turbopump discharge pressure; and (e) switching the process controllers for the turbopump bypass valve 256 and the start pump bypass valve 254 from the manual mode settings to the automatic mode settings.

In another embodiment, the method further includes circulating the working fluid within the working fluid circuit 202 by the start pump 280 prior to adjusting the inventory supply valve 198 to the opened-position. Once the turbopump discharge pressure is greater than the start pump discharge pressure ($P_e > P_c$), then the method may include opening a turbopump check valve 261 and closing a start pump check valve 281, wherein the turbopump check valve 261 may be fluidly coupled to the working fluid circuit 202 downstream of the pump portion 262 of the turbopump 260 and the start pump check valve 281 may be fluidly coupled to the working fluid circuit 202 downstream of a pump portion 282 of the start pump 280. In some examples, the method includes activating adaptive tuning on the process controller of the turbopump bypass valve 256 to change response properties for maintaining a specified setpoint.

In other exemplary embodiments, a start-up process for the turbopump 260 disposed within the heat engine system 90, 200 may achieve self-sustained operation—also referred to as "boot-strapped"—in a supercritical Rankine cycle of the working fluid circuit 202. The start-up process for the turbopump 260 may utilize the start pump 280, the turbopump check valve 261, the start pump check valve 281, the transfer pump 170, the start pump bypass valve 254, the turbopump bypass valve 256, the drive turbine throttle valve 263, as well as other valves, lines, or pumps within the working fluid circuit 202 and the heat engine system 90, 200. The turbopump check valve 261 and the start pump check valve 281 may respectively be utilized to protect the turbopump 260 and the start pump 280 from damage caused by an under or over pressurization within the working fluid circuit 202.

During the start-up process, the turbopump 260 may be accelerated until the working fluid passes through the turbopump check valve 261, which is also referred to as the "break-through" point. The "break-through" point is reached when the acceleration of the turbopump 260 increases the discharge pressure ($P_e$) of the turbopump 260 (measured at or near point $P_e$) to a value equal to or greater than the discharge pressure ($P_e$) of the start pump 280 (measured near or at point $P_c$). The discharge pressure ($P_c$) of the start pump 280 is the pressure value of the working fluid exiting the outlet of the pump portion 282 of the start pump 280 and the discharge pressure ($P_e$) of the turbopump 260 is the pressure value of the working fluid exiting the outlet of the pump portion 262 of the turbopump 260. The turbopump 260 may be controlled by the process control system 204 during the start-up process so as to not over accelerate and over pressurize the high pressure side of the working fluid 202 while reaching the "break-through" point.

In another exemplary embodiment, during the start-up process, the turbopump 260 may be utilized to supply a cooling fluid (e.g., bearing gas or the working fluid, such as $CO_2$) to bearings within the turbomachinery (e.g., components of the turbopump 260). The bearing may be well lubricated and/or cooled by the cooling/working fluid during the start-up process in order to avoid damage to the turbomachinery should the bearing supply of the cooling/working fluid become compromised or interrupted which may result in damage to components of the turbopump 260 or other turbomachinery.

In one exemplary embodiment, the bearings may be initially supplied the cooling fluid or the working fluid by an external pump (e.g., the transfer pump 170, a charging pump, a $CO_2$-feed pump) prior to the turbopump 260 achieving minimal acceleration. However, once the turbopump 260 sustains adequate acceleration, the bearings may be supplied by the cooling/working fluid from the discharge of the turbopump 260.

By coordinating a series of valves and discharge of the start pump 280, an acceleration of the turbopump 260 may be achieved that allow the working fluid to "break-through" the turbopump check valve 261 but yet remain under control so that the turbopump 260 does not over accelerate and over pressurize the high pressure side of the working fluid circuit 202.

In one exemplary embodiment, the start pump 280 and/or the start pump bypass valve 254 may be adjusted to achieve a desired start pump discharge pressure ($P_c$). The turbopump 260 may be prevented from overly accelerating by adjusting the turbopump bypass valve 256 and utilizing a control algorithm that calculates the desired pressure setpoint of the discharge pressure ($P_a$) of the transfer pump 170 that otherwise could prevent startup of the turbopump 260. The desired pressure setpoint may be measured upstream of the inventory supply valve 184 within a section of the inventory supply line 182 at or near the point $P_a$, such as between the inventory supply valve 184 and the transfer pump 170. The bearings of the turbopump 260 may be exposed to and lubricated with the working fluid by maintaining a high-low pressure side (P2−P1) differential value. In some exemplary embodiments, the high-low pressure side (P2−P1) differential value may be maintained by modulating or otherwise adjusting the start pump bypass valve 254 to control the start pump 280.

In one exemplary embodiment, once sufficient inlet pressure ($P_f$) and inlet temperature ($T_f$) of the drive turbine 264 (measured at or near point $P_f$) are achieved, an automated sequence may be initiated that includes the following:

1) Start the transfer pump 170 and build up sufficient pressure (about 2,200 psig or greater) of the working that will lubricate the bearings of the turbopump 260 through the acceleration process. The working fluid may be transferred from the mass control tank 286, through the inventory line 176, the transfer pump 170, the inventory supply line 182, and then through the bearing gas supply line and valve 196, 198, the bearing gas supply line and valve 196*a*, 198*a*, and into the bearing housing 268, as depicted in FIG. 2.

2) Once sufficient pressure is achieved and sufficient discharge pressure ($P_e$) at the outlet of the pump portion 262 of the turbopump 260 exceeds inlet pressure ($P_f$) of the drive turbine 264, the process control system 204 may be utilized to open the inventory supply valve 184 and open the drive turbine throttle valve 263 to allow the working fluid into the drive turbine 264 of the turbopump 260. In some examples, the drive turbine throttle valve 263 may be adjusted to a fully opened-position, such as 100%, or to a substantially fully opened-position, for allowing the maximum available flow of the working fluid to the drive turbine 264.

3) After a small time delay, a control algorithm calculates a "slew rate" or valve position for the turbopump bypass valve 256 and the start pump bypass valve 254 that provides sufficient acceleration of the turbopump 260 so that its discharge pressure exceeds the discharge pressure of the start pump 280 and allow the turbopump check valve 261 to open and the start pump check valve 281 to close. During this process, the controllers that manage the turbopump bypass valve 256 and the start pump bypass valve 254 are placed in a manual configuration or "open loop control," the slew rate calculation algorithm inputs the new valve positions for the turbopump bypass valve 256 and the start pump bypass valve 254 to initiate the acceleration.

4) Once acceleration is achieved, and the discharge pressure of the pump portion 262 of the turbopump 260 measured around the turbopump check valve 261 exceeds that of the maximum discharge pressure (about 2,200 psig or greater) of the pump portion 282 of the start pump 280, (therefore, that the turbopump check valve 261 is in an opened-position and the start pump check valve 281 is in a closed-position) the controllers for the turbopump bypass valve 256 and the start pump bypass valve 254 are placed back in an automatic configuration. Adaptive tuning may be activated on the turbopump bypass valve 256 to change the response characteristics of the turbopump bypass valve 256. Therefore, the turbopump bypass valve 256 may be adjusted to maintain a specified value of the system pressure setpoint within the high pressure side of the working fluid circuit 202.

5) The turbopump 260 has achieved self-sustained and stable operation within the working fluid circuit 202.

The heat engine system 200 depicted in FIG. 2 and the heat engine system 90 depicted in FIG. 1 share many common components. It should be noted that like numerals shown in the Figures and discussed herein represent like components throughout the multiple embodiments disclosed herein. The illustration of the heat engine system 200 in FIG. 2 contains the components and details of the illustration of the heat engine system 90 in FIG. 1, as well as additional components and details that are not shown in FIG. 1. These additional components and details of the heat engine system 200 in FIG. 2 are not depicted in the heat engine system 90 in FIG. 1 in order to provide a simplified illustration of the heat engine system 200.

FIG. 2 depicts the working fluid circuit 202 containing a low pressure side ($P_1$) and a high pressure side ($P_2$), as described by one or more exemplary embodiments herein. Generally, at least a portion of the working fluid circuit 202 contains the working fluid in a supercritical state. In many examples, the working fluid contains carbon dioxide and at least a portion of the carbon dioxide is in a supercritical state.

In some embodiments, the heat engine system 200 further contains the heat exchanger 150 which is generally fluidly coupled to and in thermal communication with the heat source stream 110 and independently fluidly coupled to and in thermal communication with the high pressure side of the working fluid circuit 202, such that thermal energy may be transferred from the heat source stream 110 to the working fluid. The heat exchanger 150 may be fluidly coupled to the working fluid circuit 202 upstream of the outlet of the pump portion 262 of the turbopump 260 and downstream of the inlet of the drive turbine 264 of the turbopump 260. The drive turbine throttle valve 263 may be fluidly coupled to the working fluid circuit 202 downstream of the heat exchanger 150 and upstream of the inlet of the drive turbine 264 of the turbopump 260. The working fluid containing the absorbed thermal energy flows from the heat exchanger 150 to the drive turbine 264 of the turbopump 260 via the drive turbine throttle valve 263. Therefore, in some embodiments, the drive turbine throttle valve 263 may be utilized to control the flowrate of the heated working fluid flowing from the heat exchanger 150 to the drive turbine 264 of the turbopump 260.

FIG. 2 further depicts that the waste heat system 100 of the heat engine system 200 contains three heat exchangers (e.g., the heat exchangers 120, 130, and 150) fluidly coupled to the high pressure side of the working fluid circuit 202 and in thermal communication with the heat source stream 110. Such thermal communication provides the transfer of thermal energy from the heat source stream 110 to the working fluid flowing throughout the working fluid circuit 202. In one or more embodiments disclosed herein, two, three, or more heat exchangers may be fluidly coupled to and in thermal communication with the working fluid circuit 202, such as a primary heat exchanger, a secondary heat exchanger, a tertiary heat exchanger, respectively the heat exchangers 120, 150, and 130, and/or an optional quaternary heat exchanger (not shown). For example, the heat exchanger 120 may be the primary heat exchanger fluidly coupled to the working fluid circuit 202 upstream of an inlet of the power turbine 228, the heat exchanger 150 may be the secondary heat exchanger fluidly coupled to the working fluid circuit 202 upstream of an inlet of the drive turbine 264 of the turbine pump 260, and the heat exchanger 130 may be the tertiary heat exchanger fluidly coupled to the working fluid circuit 202 upstream of an inlet of the heat exchanger 120.

The waste heat system 100 also contains an inlet 104 for receiving the heat source stream 110 and an outlet 106 for passing the heat source stream 110 out of the waste heat system 100. The heat source stream 110 flows through and from the inlet 104, through the heat exchanger 120, through one or more additional heat exchangers, if fluidly coupled to the heat source stream 110, and to and through the outlet 106. In some examples, the heat source stream 110 flows through and from the inlet 104, through the heat exchangers 120, 150, and 130, respectively, and to and through the outlet 106. The heat source stream 110 may be routed to flow through the heat exchangers 120, 130, 150, and/or additional heat exchangers in other desired orders.

The heat source stream 110 may be a waste heat stream such as, but not limited to, gas turbine exhaust stream, industrial process exhaust stream, or other combustion product exhaust streams, such as furnace or boiler exhaust streams. The heat source stream 110 may be at a temperature within a range from about 100° C. to about 1,000° C., or greater than 1,000° C., and in some examples, within a range from about 200° C. to about 800° C., more narrowly within a range from about 300° C. to about 700° C., and more narrowly within a range from about 400° C. to about 600° C., for example, within a range from about 500° C. to about 550° C. The heat source stream 110 may contain air, carbon dioxide, carbon monoxide, water or steam, nitrogen, oxygen, argon, derivatives thereof, or mixtures thereof. In some embodiments, the heat source stream 110 may derive thermal energy from renewable sources of thermal energy, such as solar or geothermal sources.

In some embodiments, the types of working fluid that may be circulated, flowed, or otherwise utilized in the working fluid circuit 202 of the heat engine system 200 include carbon oxides, hydrocarbons, alcohols, ketones, halogenated hydrocarbons, ammonia, amines, aqueous, or combinations thereof. Exemplary working fluids that may be utilized in the heat engine system 200 include carbon dioxide, ammonia, methane, ethane, propane, butane, ethylene, propylene, butylene, acetylene, methanol, ethanol, acetone, methyl ethyl ketone, water, derivatives thereof, or mixtures thereof. Halogenated hydrocarbons may include hydrochlorofluorocarbons (HCFCs), hydrofluorocarbons (HFCs) (e.g., 1,1,1,3,3-pentafluoropropane (R245fa)), fluorocarbons, derivatives thereof, or mixtures thereof.

In many embodiments described herein, the working fluid the working fluid circulated, flowed, or otherwise utilized in the working fluid circuit 202 of the heat engine system 200, and the other exemplary circuits disclosed herein, may be or may contain carbon dioxide ($CO_2$) and mixtures containing carbon dioxide. Generally, at least a portion of the working fluid circuit 202 contains the working fluid in a supercritical state (e.g., sc-$CO_2$). Carbon dioxide utilized as the working fluid or contained in the working fluid for power generation cycles has many advantages over other compounds typical used as working fluids, since carbon dioxide has the properties of being non-toxic and non-flammable and is also easily available and relatively inexpensive. Due in part to a relatively high working pressure of carbon dioxide, a carbon dioxide system may be much more compact than systems using other working fluids. The high density and volumetric heat capacity of carbon dioxide with respect to other working fluids makes carbon dioxide more "energy dense" meaning that the size of all system components may be considerably reduced without losing performance. It should be noted that use of the terms carbon dioxide ($CO_2$), supercritical carbon dioxide (sc-$CO_2$), or subcritical carbon dioxide (sub-$CO_2$) is not intended to be limited to carbon dioxide of any particular type, source, purity, or grade. For example, industrial grade carbon dioxide may be contained in and/or used as the working fluid without departing from the scope of the disclosure.

In other exemplary embodiments, the working fluid in the working fluid circuit 202 may be a binary, ternary, or other working fluid blend. The working fluid blend or combination may be selected for the unique attributes possessed by the fluid combination within a heat recovery system, as described herein. For example, one such fluid combination includes a liquid absorbent and carbon dioxide mixture enabling the combined fluid to be pumped in a liquid state to high pressure with less energy input than required to compress carbon dioxide. In another exemplary embodiment, the working fluid may be a combination of carbon dioxide (e.g., sub-$CO_2$ or sc-$CO_2$) and one or more other miscible fluids or chemical compounds. In yet other exemplary embodiments, the working fluid may be a combination of carbon dioxide and propane, or carbon dioxide and ammonia, without departing from the scope of the disclosure.

The working fluid circuit 202 generally has a high pressure side and a low pressure side and contains a working fluid circulated within the working fluid circuit 202. The use of the term "working fluid" is not intended to limit the state or phase of matter of the working fluid. For instance, the working fluid or portions of the working fluid may be in a liquid phase, a gas phase, a fluid phase, a subcritical state, a supercritical state, or any other phase or state at any one or more points within the heat engine system 200 or thermodynamic cycle. In one or more embodiments, the working fluid is in a supercritical state over certain portions of the working fluid circuit 202 of the heat engine system 200 (e.g., a high pressure side) and in a subcritical state over other portions of the working fluid circuit 202 of the heat engine system 200 (e.g., a low pressure side). FIG. 2 depicts the low and high pressure sides of the working fluid circuit 202 of the heat engine system 200 by representing the high pressure side with "------" and the low pressure side with "-•-•-•"—as described in one or more embodiments. In other embodiments, the entire thermodynamic cycle may be operated such that the working fluid is maintained in either a supercritical or subcritical state throughout the entire working fluid circuit 202 of the heat engine system 200.

Generally, the high pressure side of the working fluid circuit 202 contains the working fluid (e.g., sc-$CO_2$) at a pressure of about 15 MPa or greater, such as about 17 MPa or greater or about 20 MPa or greater. In some examples, the high pressure side of the working fluid circuit 202 may have a pressure within a range from about 15 MPa to about 30 MPa, more narrowly within a range from about 16 MPa to about 26 MPa, more narrowly within a range from about 17 MPa to about 25 MPa, and more narrowly within a range from about 17 MPa to about 24 MPa, such as about 23.3 MPa. In other examples, the high pressure side of the working fluid circuit 202 may have a pressure within a range from about 20 MPa to about 30 MPa, more narrowly within a range from about 21 MPa to about 25 MPa, and more narrowly within a range from about 22 MPa to about 24 MPa, such as about 23 MPa.

The low pressure side of the working fluid circuit 202 contains the working fluid (e.g., $CO_2$ or sub-$CO_2$) at a pressure of less than 15 MPa, such as about 12 MPa or less or about 10 MPa or less. In some examples, the low pressure side of the working fluid circuit 202 may have a pressure within a range from about 4 MPa to about 14 MPa, more narrowly within a range from about 6 MPa to about 13 MPa, more narrowly within a range from about 8 MPa to about 12 MPa, and more narrowly within a range from about 10 MPa to about 11 MPa, such as about 10.3 MPa. In other examples, the low pressure side of the working fluid circuit 202 may have a pressure within a range from about 2 MPa to about 10 MPa, more narrowly within a range from about 4 MPa to about 8 MPa, and more narrowly within a range from about 5 MPa to about 7 MPa, such as about 6 MPa.

In some examples, the high pressure side of the working fluid circuit 202 may have a pressure within a range from about 17 MPa to about 23.5 MPa, and more narrowly within a range from about 23 MPa to about 23.3 MPa while the low pressure side of the working fluid circuit 202 may have a pressure within a range from about 8 MPa to about 11 MPa, and more narrowly within a range from about 10.3 MPa to about 11 MPa.

The heat engine system 200 further contains the power turbine 228 disposed between the high pressure side and the low pressure side of the working fluid circuit 202, disposed downstream of the heat exchanger 120, and fluidly coupled to and in thermal communication with the working fluid. The power turbine 228 may be configured to convert a pressure drop in the working fluid to mechanical energy whereby the absorbed thermal energy of the working fluid is transformed to mechanical energy of the power turbine 228. Therefore, the power turbine 228 is an expansion device capable of transforming a pressurized fluid into mechanical energy, generally, transforming high temperature and pressure fluid into mechanical energy, such as rotating a shaft.

The power turbine 228 may contain or be a turbine, a turbo, an expander, or another device for receiving and expanding the working fluid discharged from the heat exchanger 120. The power turbine 228 may have an axial construction or radial construction and may be a single-staged device or a multi-staged device. Exemplary turbines that may be utilized in power turbine 228 include an expansion device, a geroler, a gerotor, a valve, other types of positive displacement devices such as a pressure swing, a turbine, a turbo, or any other device capable of transforming a pressure or pressure/enthalpy drop in a working fluid into mechanical energy. A variety of expanding devices are capable of working within the inventive system and achieving different performance properties that may be utilized as the power turbine 228.

The power turbine 228 is generally coupled to the power generator 240 by the driveshaft 230. A gearbox 232 is generally disposed between the power turbine 228 and the power generator 240 and adjacent or encompassing the driveshaft 230. The driveshaft 230 may be a single piece or contain two or more pieces coupled together. In one or more examples, a first segment of the driveshaft 230 extends from the power turbine 228 to the gearbox 232, a second segment of the driveshaft 230 extends from the gearbox 232 to the power generator 240, and multiple gears are disposed between and coupled to the two segments of the driveshaft 230 within the gearbox 232.

In some configurations, the heat engine system 200 also provides for the delivery of a portion of the working fluid, seal gas, bearing gas, air, or other gas into a chamber or housing, such as a housing 238 within the power generation system 220 for purposes of cooling one or more parts of the power turbine 228. In other configurations, the driveshaft 230 includes a seal assembly (not shown) designed to prevent or capture any working fluid leakage from the power turbine 228. Additionally, a working fluid recycle system may be implemented along with the seal assembly to recycle seal gas back into the working fluid circuit 202 of the heat engine system 200.

The power generator 240 may be a generator, an alternator (e.g., permanent magnet alternator), or other device for generating electrical energy, such as transforming mechanical energy from the driveshaft 230 and the power turbine 228 to electrical energy. A power outlet 242 is electrically coupled to the power generator 240 and may be configured to transfer the generated electrical energy from the power generator 240 and to an electrical grid 244. The electrical grid 244 may be or include an electrical grid, an electrical bus (e.g., plant bus), power electronics, other electric circuits, or combinations thereof. The electrical grid 244 generally contains at least one alternating current bus, alternating current grid, alternating current circuit, or combinations thereof. In one example, the power generator 240 is a generator and is electrically and operably connected to the electrical grid 244 via the power outlet 242. In another example, the power generator 240 is an alternator and is electrically and operably connected to power electronics (not shown) via the power outlet 242. In another example, the power generator 240 is electrically connected to power electronics which are electrically connected to the power outlet 242.

The power electronics may be configured to convert the electrical power into desirable forms of electricity by modifying electrical properties, such as voltage, current, or frequency. The power electronics may include converters or rectifiers, inverters, transformers, regulators, controllers, switches, resisters, storage devices, and other power electronic components and devices. In other embodiments, the power generator 240 may contain, be coupled with, or be other types of load receiving equipment, such as other types of electrical generation equipment, rotating equipment, a gearbox (e.g., gearbox 232), or other device configured to modify or convert the shaft work created by the power turbine 228. In one embodiment, the power generator 240 is in fluid communication with a cooling loop having a radiator and a pump for circulating a cooling fluid, such as water, thermal oils, and/or other suitable refrigerants. The cooling loop may be configured to regulate the temperature of the power generator 240 and power electronics by circulating the cooling fluid to draw away generated heat.

The heat engine system 200 also provides for the delivery of a portion of the working fluid into a chamber or housing of the power turbine 228 for purposes of cooling one or more parts of the power turbine 228. In one embodiment, due to the potential need for dynamic pressure balancing within the power generator 240, the selection of the site within the heat engine system 200 from which to obtain a portion of the working fluid is critical because introduction of this portion of the working fluid into the power generator 240 should respect or not disturb the pressure balance and stability of the power generator 240 during operation. Therefore, the pressure of the working fluid delivered into the power generator 240 for purposes of cooling is the same or substantially the same as the pressure of the working fluid at an inlet of the power turbine 228. The working fluid is conditioned to be at a desired temperature and pressure prior to being introduced into the power turbine 228. A portion of the working fluid, such as the spent working fluid, exits the power turbine 228 at an outlet of the power turbine 228 and is directed to one or more heat exchangers or recuperators, such as the recuperators 216 and 218. The recuperators 216 and 218 may be fluidly coupled to the working fluid circuit 202 in series with each other. The recuperators 216 and 218 are operative to transfer thermal energy between the high pressure side and the low pressure side of the working fluid circuit 202. In one exemplary embodiment, each of the recuperators 216 and 218 may be configured to transfer thermal energy from the low pressure side to the high pressure side of the working fluid circuit 202.

In one embodiment, the recuperator 216 may be fluidly coupled to the low pressure side of the working fluid circuit 202, disposed downstream of a working fluid outlet on the power turbine 228, and disposed upstream of the recuperator 218 and/or the condenser 274. The recuperator 216 may be configured to remove at least a portion of thermal energy from the working fluid discharged from the power turbine 228. In addition, the recuperator 216 is also fluidly coupled to the high pressure side of the working fluid circuit 202, disposed upstream of the heat exchanger 120 and/or a working fluid inlet on the power turbine 228, and disposed downstream of the heat exchanger 130. The recuperator 216 may be configured to increase the amount of thermal energy in the working fluid prior to flowing into the heat exchanger 120 and/or the power turbine 228. Therefore, the recuperator 216 is operative to transfer thermal energy between the high pressure side and the low pressure side of the working fluid circuit 202. In some examples, the recuperator 216 may be a heat exchanger configured to cool the low pressurized working fluid discharged or downstream of the power turbine 228 while heating the high pressurized working fluid entering into or upstream of the heat exchanger 120 and/or the power turbine 228.

Similarly, in another embodiment, the recuperator 218 may be fluidly coupled to the low pressure side of the working fluid circuit 202, disposed downstream of a working fluid outlet on the power turbine 228 and/or the recuperator 216, and disposed upstream of the condenser 274. The recuperator 218 may be configured to remove at least a portion of thermal energy from the working fluid discharged from the power turbine 228 and/or the recuperator 216. In addition, the recuperator 218 is also fluidly coupled to the high pressure side of the working fluid circuit 202, disposed upstream of the heat exchanger 150 and/or a working fluid inlet on a drive turbine 264 of turbopump 260, and disposed downstream of a working fluid outlet on a pump portion 262 of turbopump 260. The recuperator 218 may be configured to increase the amount of thermal energy in the working fluid prior to flowing into the heat exchanger 150 and/or the drive turbine 264. Therefore, the recuperator 218 is operative to transfer thermal energy between the high pressure side and the low pressure side of the working fluid circuit 202. In some examples, the recuperator 218 may be a heat exchanger configured to cool the low pressurized working fluid discharged or downstream of the power turbine 228 and/or the recuperator 216 while heating the high pressurized working fluid entering into or upstream of the heat exchanger 150 and/or the drive turbine 264.

A cooler or a condenser 274 may be fluidly coupled to and in thermal communication with the low pressure side of the working fluid circuit 202 and may be configured or operative to control a temperature of the working fluid in the low pressure side of the working fluid circuit 202. The condenser 274 may be disposed downstream of the recuperators 216 and 218 and upstream of the start pump 280 and the turbopump 260. The condenser 274 receives the cooled working fluid from the recuperator 218 and further cools and/or condenses the working fluid which may be recirculated throughout the working fluid circuit 202. In many examples, the condenser 274 is a cooler and may be configured to control a temperature of the working fluid in the low pressure side of the working fluid circuit 202 by transferring thermal energy from the working fluid in the low pressure side to a cooling loop or system outside of the working fluid circuit 202.

A cooling media or fluid is generally utilized in the cooling loop or system by the condenser 274 for cooling the working fluid and removing thermal energy outside of the working fluid circuit 202. The cooling media or fluid flows through, over, or around while in thermal communication with the condenser 274. Thermal energy in the working fluid is transferred to the cooling fluid via the condenser 274. Therefore, the cooling fluid is in thermal communication with the working fluid circuit 202, but not fluidly coupled to the working fluid circuit 202. The condenser 274 may be fluidly coupled to the working fluid circuit 202 and independently fluidly coupled to the cooling fluid. The cooling fluid may contain one or multiple compounds and may be in one or multiple states of matter. The cooling fluid may be a media or fluid in a gaseous state, a liquid state, a subcritical state, a supercritical state, a suspension, a solution, derivatives thereof, or combinations thereof.

In many examples, the condenser 274 is generally fluidly coupled to a cooling loop or system (not shown) that receives the cooling fluid from a cooling fluid return 278*a* and returns the warmed cooling fluid to the cooling loop or system via a cooling fluid supply 278*b*. The cooling fluid may be water, carbon dioxide, or other aqueous and/or organic fluids (e.g., alcohols and/or glycols), air or other gases, or various mixtures thereof that is maintained at a lower temperature than the temperature of the working fluid. In other examples, the cooling media or fluid contains air or another gas exposed to the condenser 274, such as an air steam blown by a motorized fan or blower. A filter 276 may be disposed along and in fluid communication with the cooling fluid line at a point downstream of the cooling fluid supply 278*b* and upstream of the condenser 274. In some examples, the filter 276 may be fluidly coupled to the cooling fluid line within the process system 210.

The heat engine system 200 further contains several pumps, such as a turbopump 260 and a start pump 280, disposed within the working fluid circuit 202 and fluidly coupled between the low pressure side and the high pressure side of the working fluid circuit 202. The turbopump 260 and the start pump 280 are operative to circulate the working fluid throughout the working fluid circuit 202. The start pump 280 is generally a motorized pump and may be utilized to initially pressurize and circulate the working fluid in the working fluid circuit 202. Once a predetermined pressure, temperature, and/or flowrate of the working fluid is obtained within the working fluid circuit 202, the start pump 280 may be taken off line, idled, or turned off and the turbopump 260 is utilize to circulate the working fluid during the electricity generation process. The working fluid enters each of the turbopump 260 and the start pump 280 from the low pressure side of the working fluid circuit 202 and exits each of the turbopump 260 and the start pump 280 from the high pressure side of the working fluid circuit 202.

The start pump 280 may be a motorized pump, such as an electric motorized pump, a mechanical motorized pump, or other type of pump. Generally, the start pump 280 may be a variable frequency motorized drive pump and contains a pump portion 282 and a motor-drive portion 284. The motor-drive portion 284 of the start pump 280 contains a motor and a drive including a driveshaft and gears. In some examples, the motor-drive portion 284 has a variable frequency drive, such that the speed of the motor may be regulated by the drive. The pump portion 282 of the start pump 280 is driven by the motor-drive portion 284 coupled thereto. The pump portion 282 has an inlet for receiving the working fluid from the low pressure side of the working fluid circuit 202, such as from the condenser 274 and/or the mass control tank 286. The pump portion 282 has an outlet for releasing the working fluid into the high pressure side of the working fluid circuit 202.

Start pump inlet valve 283 and start pump outlet valve 285 may be utilized to control the flow of the working fluid passing through the start pump 280. Start pump inlet valve 283 may be fluidly coupled to the low pressure side of the working fluid circuit 202 upstream of the pump portion 282 of the start pump 280 and may be utilized to control the flowrate of the working fluid entering the inlet of the pump portion 282. Start pump outlet valve 285 may be fluidly coupled to the high pressure side of the working fluid circuit 202 downstream of the pump portion 282 of the start pump 280 and may be utilized to control the flowrate of the working fluid exiting the outlet of the pump portion 282.

The turbopump 260 is generally a turbo-drive pump or a turbine-drive pump and utilized to pressurize and circulate the working fluid throughout the working fluid circuit 202. The turbopump 260 contains a pump portion 262 and a drive turbine 264 coupled together by a driveshaft 267 and an optional gearbox (not shown). The drive turbine 264 may be configured to rotate the pump portion 262 and the pump portion 262 may be configured to circulate the working fluid within the working fluid circuit 202.

The driveshaft 267 may be a single piece or contain two or more pieces coupled together. In one or more examples, a first segment of the driveshaft 267 extends from the drive turbine 264 to the gearbox, a second segment of the driveshaft 230 extends from the gearbox to the pump portion 262, and multiple gears are disposed between and coupled to the two segments of the driveshaft 267 within the gearbox.

The drive turbine 264 of the turbopump 260 is driven by heated working fluid, such as the working fluid flowing from the heat exchanger 150. The drive turbine 264 may be fluidly coupled to the high pressure side of the working fluid circuit 202 by an inlet configured to receive the working fluid from the high pressure side of the working fluid circuit 202, such as flowing from the heat exchanger 150. The drive turbine 264 may be fluidly coupled to the low pressure side of the working fluid circuit 202 by an outlet configured to release the working fluid into the low pressure side of the working fluid circuit 202.

The pump portion 262 of the turbopump 260 is driven by the driveshaft 267 coupled to the drive turbine 264. The pump portion 262 of the turbopump 260 may be fluidly coupled to the low pressure side of the working fluid circuit 202 by an inlet configured to receive the working fluid from the low pressure side of the working fluid circuit 202. The inlet of the pump portion 262 may be configured to receive the working fluid from the low pressure side of the working fluid circuit 202, such as from the condenser 274 and/or the mass control tank 286. Also, the pump portion 262 may be fluidly coupled to the high pressure side of the working fluid circuit 202 by an outlet configured to release the working fluid into the high pressure side of the working fluid circuit 202 and circulate the working fluid within the working fluid circuit 202.

In one configuration, the working fluid released from the outlet on the drive turbine 264 is returned into the working fluid circuit 202 downstream of the recuperator 216 and upstream of the recuperator 218. In one or more embodiments, the turbopump 260, including piping and valves, is optionally disposed on a turbopump skid 266, as depicted in FIG. 2. The turbopump skid 266 may be disposed on or adjacent to the main process skid 212.

A drive turbine bypass valve 265 is generally coupled between and in fluid communication with a fluid line extending from the inlet on the drive turbine 264 with a fluid line extending from the outlet on the drive turbine 264. The drive turbine bypass valve 265 is generally opened to bypass the turbopump 260 while using the start pump 280 during the initial stages of generating electricity with the heat engine system 200. Once a predetermined pressure and temperature of the working fluid is obtained within the working fluid circuit 202, the drive turbine bypass valve 265 is closed and the heated working fluid is flowed through the drive turbine 264 to start the turbopump 260.

The drive turbine throttle valve 263 may be coupled between and in fluid communication with a fluid line extending from the heat exchanger 150 to the inlet on the drive turbine 264 of the turbopump 260. The drive turbine throttle valve 263 may be configured to modulate the flow of the heated working fluid into the drive turbine 264 which in turn—may be utilized to adjust the flow of the working fluid throughout the working fluid circuit 202. Additionally, a valve 293 may be utilized to control the flow of the working fluid passing through the high pressure side of the recuperator 218 and through the heat exchanger 150. The additional thermal energy absorbed by the working fluid from the recuperator 218 and the heat exchanger 150 is transferred to the drive turbine 264 for powering or otherwise driving the pump portion 262 of the turbopump 260. The valve 293 may be utilized to provide and/or control back pressure for the drive turbine 264 of the turbopump 260.

A drive turbine attemperator valve 295 may be fluidly coupled to the working fluid circuit 202 via an attemperator bypass line 291 disposed between the outlet on the pump portion 262 of the turbopump 260 and the inlet on the drive turbine 264 and/or disposed between the outlet on the pump portion 282 of the start pump 280 and the inlet on the drive turbine 264. The attemperator bypass line 291 and the drive turbine attemperator valve 295 may be configured to flow the working fluid from the pump portion 262 or 282, around and avoid the recuperator 218 and the heat exchanger 150, and to the drive turbine 264, such as during a warm-up or cool-down step of the turbopump 260. The attemperator bypass line 291 and the drive turbine attemperator valve 295 may be utilized to warm the working fluid with the drive turbine 264 while avoiding the thermal heat from the heat source stream 110 via the heat exchangers, such as the heat exchanger 150.

The turbopump check valve 261 may be disposed downstream of the outlet of the pump portion 262 of the turbopump 260 and the start pump check valve 281 may be disposed downstream of the outlet of the pump portion 282 of the start pump 280. The turbopump check valve 261 and the start pump check valve 281 are flow control safety valves and may be utilized to release an over-pressure, regulate the directional flow, or prohibit backflow of the working fluid within the working fluid circuit 202. The turbopump check valve 261 may be configured to prevent the working fluid from flowing upstream towards or into the outlet of the pump portion 262 of the turbopump 260. Similarly, check valve 281 may be configured to prevent the working fluid from flowing upstream towards or into the outlet of the pump portion 282 of the start pump 280.

The drive turbine throttle valve 263 may be fluidly coupled to the working fluid circuit 202 upstream of the inlet of the drive turbine 264 of the turbopump 260 and may be configured to control a flow of the working fluid flowing into the drive turbine 264. A power turbine bypass valve 219 may be fluidly coupled to a power turbine bypass line 208 and may be configured to modulate, adjust, or otherwise control the working fluid flowing through the power turbine bypass line 208 for controlling the flowrate of the working fluid entering the power turbine 228. The power turbine bypass line 208 may be fluidly coupled to the working fluid circuit 202 at a point upstream of an inlet of the power turbine 228 and at a point downstream of an outlet of the power turbine 228. The power turbine bypass line 208 may be configured to flow the working fluid around and avoid the power turbine 228 when the power turbine bypass valve 219 is in an opened-position. The flowrate and the pressure of the working fluid flowing into the power turbine 228 may be reduced or stopped by adjusting the power turbine bypass valve 219 to the opened-position. Alternatively, the flowrate and the pressure of the working fluid flowing into the power turbine 228 may be increased or started by adjusting the power turbine bypass valve 219 to the closed-position due to the backpressure formed through the power turbine bypass line 208.

The power turbine bypass valve 219 and the drive turbine throttle valve 263 may be independently controlled by the process control system 204 that is communicably connected, wired and/or wirelessly, with the power turbine bypass valve 219, the drive turbine throttle valve 263, and other parts of the heat engine system 200. The process control system 204 is operatively connected to the working fluid circuit 202 and a mass management system 270 and is enabled to monitor and control multiple process operation parameters of the heat engine system 200.

FIG. 2 further depicts a power turbine throttle valve 250 fluidly coupled to a bypass line 246 on the high pressure side of the working fluid circuit 202 and upstream of the heat exchanger 120, as disclosed by at least one embodiment described herein. The power turbine throttle valve 250 may be fluidly coupled to the bypass line 246 and may be configured to modulate, adjust, or otherwise control the working fluid flowing through the bypass line 246 for controlling a general coarse flowrate of the working fluid within the working fluid circuit 202. The bypass line 246 may be fluidly coupled to the working fluid circuit 202 at a point upstream of the valve 293 and at a point downstream of the pump portion 282 of the start pump 280 and/or the pump portion 262 of the turbopump 260. Additionally, a power turbine trim valve 252 may be fluidly coupled to a bypass line 248 on the high pressure side of the working fluid circuit 202 and upstream of the heat exchanger 150, as disclosed by another embodiment described herein. The power turbine trim valve 252 may be fluidly coupled to the bypass line 248 and may be configured to modulate, adjust, or otherwise control the working fluid flowing through the bypass line 248 for controlling a fine flowrate of the working fluid within the working fluid circuit 202. The bypass line 248 may be fluidly coupled to the bypass line 246 at a point upstream of the power turbine throttle valve 250 and at a point downstream of the power turbine throttle valve 250. In one exemplary embodiment, the system controller for the turbopump bypass valve 256 may be utilized to control the power turbine throttle valve 250 as V1 and the power turbine trim valve 252 as V2.

A heat exchanger bypass line 160 may be fluidly coupled to a fluid line 131 of the working fluid circuit 202 upstream of the heat exchangers 120, 130, and/or 150 by a heat exchanger bypass valve 162, as illustrated in FIG. 2. The heat exchanger bypass valve 162 may be a solenoid valve, a hydraulic valve, an electric valve, a manual valve, or derivatives thereof. In many examples, the heat exchanger bypass valve 162 is a solenoid valve and may be configured to be controlled by the process control system 204.

In one or more embodiments, the working fluid circuit 202 provides release valves 213*a*, 213*b*, 213*c*, and 213*d*, as well as release outlets 214*a*, 214*b*, 214*c*, and 214*d*, respectively in fluid communication with each other. Generally, the release valves 213*a*, 213*b*, 213*c*, and 213*d* remain closed during the electricity generation process, but may be configured to automatically open to release an over-pressure at a predetermined value within the working fluid. Once the working fluid flows through the valve 213*a*, 213*b*, 213*c*, or 213*d*, the working fluid is vented through the respective release outlet 214*a*, 214*b*, 214*c*, or 214*d*. The release outlets 214*a*, 214*b*, 214*c*, and 214*d* may provide passage of the working fluid into the ambient surrounding atmosphere. Alternatively, the release outlets 214*a*, 214*b*, 214*c*, and 214*d* may provide passage of the working fluid into a recycling or reclamation step that generally includes capturing, condensing, and storing the working fluid.

The release valve 213*a* and the release outlet 214*a* are fluidly coupled to the working fluid circuit 202 at a point disposed between the heat exchanger 120 and the power turbine 228. The release valve 213*b* and the release outlet 214*b* are fluidly coupled to the working fluid circuit 202 at a point disposed between the heat exchanger 150 and the turbo portion 264 of the turbopump 260. The release valve 213*c* and the release outlet 214*c* are fluidly coupled to the working fluid circuit 202 via a bypass line that extends from a point between the valve 293 and the pump portion 262 of the turbopump 260 to a point on the turbopump bypass line 226 between the turbopump bypass valve 256 and the fluid line 229. The release valve 213*d* and the release outlet 214*d* are fluidly coupled to the working fluid circuit 202 at a point disposed between the recuperator 218 and the condenser 274.

FIGS. 1 and 2 depict the heat engine system 90, 200 containing the mass management system (MMS) 270 fluidly coupled to the working fluid circuit 202, as described by embodiments herein. The mass management system 270, also referred to as an inventory management system, may be utilized to control the amount of working fluid added to, contained within, or removed from the working fluid circuit 202. The mass management system 270 contains at least one vessel or tank, such as a mass control tank 286, which may be a storage vessel, a fill vessel, fluidly coupled to the working fluid circuit 202 via one or more fluid lines and/or valves. Exemplary embodiments of the mass management system 270, and a range of variations thereof, are found in U.S. Pat. No. 8,613,195, the contents of which are incorporated herein by reference to the extent consistent with the present disclosure. The mass management system 270 may include a plurality of valves and/or connection points, each in fluid communication with the mass control tank 286. The valves may be characterized as termination points where the mass management system 270 is operatively connected to the heat engine system 90, 200. The connection points and valves may be configured to provide the mass management system 270 with an outlet for flaring excess working fluid or pressure, or to provide the mass management system 270 with additional/supplemental working fluid from an external source, such as a fluid fill system. In some embodiments, the mass control tank 286 may be configured as a localized storage tank for additional/supplemental working fluid that may be added to the heat engine system 90, 200 when needed in order to regulate the pressure or temperature of the working fluid within the working fluid circuit 202 or otherwise supplement escaped or vented working fluid. By controlling the valves, the mass management system 270 adds and/or removes working fluid mass to/from the working fluid circuit 202 with or without the need of a pump, thereby reducing system cost, complexity, and maintenance.

In one exemplary embodiment, as depicted in FIGS. 1 and 2, the mass management system 270 may have two or more transfer lines that may be configured to have one-directional flow, such an inventory return line 172 and an inventory supply line 182. Therefore, the mass management system 270 may contain the mass control tank 286 and the transfer pump 170 connected in series by an inventory line 176 and may further contain the inventory return line 172 and the inventory supply line 182. The inventory return line 172 may be fluidly coupled between the working fluid circuit 202 and the mass control tank 286. An inventory return valve 174 may be fluidly coupled to the inventory return line 172 and may be configured to remove the working fluid from the working fluid circuit 202. Also, the inventory supply line 182 may be fluidly coupled between the transfer pump 170 and the working fluid circuit 202. An inventory supply valve 184 may be fluidly coupled to the inventory supply line 182 and may be configured to add the working fluid into the working fluid circuit 202 or transfer to a bearing gas supply line 196.

In some exemplary embodiments, at least one connection point, such as a working fluid feed 288, may be a fluid fill port for or on the mass control tank 286 of the mass management system 270. Additional or supplemental working fluid may be added to the mass management system 270 from an external source, such as a storage tank or a fluid fill system via the working fluid feed 288. Exemplary fluid fill systems are described and illustrated in U.S. Pat. No. 8,281,593, the contents of which are incorporated herein by reference to the extent consistent with the present disclosure.

In some configurations, the overall efficiency of the heat engine system 90, 200 and the amount of power ultimately generated may be influenced by the inlet or suction pressure at the pump when the working fluid contains supercritical carbon dioxide. In order to minimize or otherwise regulate the suction pressure of the pump, the heat engine system 90, 200 may incorporate the use of the mass management system 270. The mass management system 270 may be utilized to control the inlet pressure of the start pump 280 by regulating the amount of working fluid entering and/or exiting the heat engine system 90, 200 at strategic locations in the working fluid circuit 202, such as at tie-in points, inlets/outlets, valves, or conduits throughout the heat engine system 90, 200. Consequently, the heat engine system 200 becomes more efficient by increasing the pressure ratio for the start pump 280 to a maximum possible extent.

In another embodiment, the heat engine system 90, 200 may further contain the bearing gas supply line 196 fluidly coupled to and between the inventory supply line 182 and a bearing-containing device 194, as depicted in FIGS. 1 and 2. The bearing-containing device 194, for example, may be the bearing housing 268 of the turbopump 260, the bearing housing 238 of the power generation system 220, or other components containing bearings utilized within or along with the heat engine system 90, 200. The bearing gas supply line 196 generally contains at least one valve, such as bearing gas supply valve 198, configured to control the flow of the working fluid from the inventory supply line 182, through the bearing gas supply line 196, and to bearing-containing device 194. In another aspect, the bearing gas supply line 196 may be utilized during a startup process to transfer or otherwise deliver the working fluid—as a cooling agent—to bearings contained within a bearing housing of a system component (e.g., rotary equipment or turbo machinery).

In other embodiments, the transfer pump 170 may also be configured to transfer the working fluid from the mass control tank 286 to the bearing housings 238, 268 that completely, substantially, or partially encompass or otherwise enclose bearings contained within a system component. FIG. 2 depicts the heat engine system 200 further containing bearing gas supply lines 196, 196*a*, 196*b* fluidly coupled to and between the transfer pump 170 and the bearing housing 238, 268. The bearing gas supply lines 196, 196*a*, 196*b* generally contain at least one valve, such as bearing gas supply valves 198*a*, 198*b*, configured to control the flow of the working fluid from the mass control tank 286, through the transfer pump 170, and to the bearing housing 238, 268. In various examples, the system component may be a turbopump, a turbocompressor, a turboalternator, a power generation system, other turbomachinery, and/or other bearing-containing devices 194 (as depicted in FIG. 1). In some examples, the system component may be the system pump, such as the turbopump 260 containing the bearing housing 268. In other examples, the system component may be the power generation system 220 that contains the expander or the power turbine 228, the power generator 240, and the bearing housing 238.

The mass control tank 286 and the working fluid circuit 202 share the working fluid (e.g., carbon dioxide)—such that the mass control tank 286 may receive, store, and disperse the working fluid during various operational steps of the heat engine system 90, 200. In one embodiment, the transfer pump 170 may be utilized to conduct inventory control by removing working fluid from the working fluid circuit 202, storing working fluid, and/or adding working fluid into the working fluid circuit 202. In another embodiment, the transfer pump 170 may be utilized during a startup process to transfer or otherwise deliver the working fluid—as a cooling agent—from the mass control tank 286 to bearings contained within the bearing housing 268 of the turbopump 260, the bearing housing 238 of the power generation system 220, and/or other system components containing bearings (e.g., rotary equipment or turbo machinery).

Exemplary structures of the bearing housing 238 or 268 may completely or substantially encompass or enclose the bearings as well as all or part of turbines, generators, pumps, driveshafts, gearboxes, or other components shown or not shown for the heat engine system 90, 200. The bearing housing 238 or 268 may completely or partially include structures, chambers, cases, housings, such as turbine housings, generator housings, driveshaft housings, driveshafts that contain bearings, gearbox housings, derivatives thereof, or combinations thereof. FIG. 2 depicts the bearing housing 238 containing all or a portion of the power turbine 228, the power generator 240, the driveshaft 230, and the gearbox 232 of the power generation system 220. In some examples, the housing of the power turbine 228 is coupled to and/or forms a portion of the bearing housing 238. Similarly, the bearing housing 268 contains all or a portion of the drive turbine 264, the pump portion 262, and the driveshaft 267 of the turbopump 260. In other examples, the housing of the drive turbine 264 and the housing of the pump portion 262 may be independently coupled to and/or form portions of the bearing housing 268.

In one or more embodiments disclosed herein, at least one bearing gas supply line 196 may be fluidly coupled to and disposed between the transfer pump 170 and at least one bearing housing (e.g., bearing housing 238 or 268) substantially encompassing, enclosing, or otherwise surrounding the bearings of one or more system components. One or multiple streams of bearing fluid/gas and/or seal gas may be derived from the working fluid within the working fluid circuit 202 or from another source and contain carbon dioxide in a gaseous, subcritical, or supercritical state. The bearing gas supply line 196 may have or otherwise split into multiple spurs or segments of fluid lines, such as bearing gas supply lines 196*a* and 196*b*, which each independently extends to a specified bearing housing 238 or 268, respectively, as illustrated in FIG. 2. In one example, the bearing gas supply line 196*a* may be fluidly coupled to and disposed between the transfer pump 170 and the bearing housing 268 within the turbopump 260. In another example, the bearing gas supply line 196*b* may be fluidly coupled to and disposed between the transfer pump 170 and the bearing housing 238 within the power generation system 220.

FIG. 2 further depicts a bearing gas supply valve 198*a* fluidly coupled to and disposed along the bearing gas supply line 196*a*. The bearing gas supply valve 198*a* may be utilized to control the flow of the working fluid from the transfer pump 170 to the bearing housing 268 within the turbopump 260. Similarly, a bearing gas supply valve 198*b* may be fluidly coupled to and disposed along the bearing gas supply line 196*b*. The bearing gas supply valve 198*b* may be utilized to control the flow of the working fluid from the transfer pump 170 to the bearing housing 238 within the power generation system 220.

The process control system 204, containing the computer system 206, may be communicably connected, wired and/or wirelessly, with numerous sets of sensors, valves, and pumps, in order to process the measured and reported temperatures, pressures, and mass flowrates of the working fluid at designated points within the working fluid circuit 202. In response to these measured and/or reported parameters, the process control system 204 may be operable to selectively adjust the valves in accordance with a control program or control algorithm, thereby maximizing operation of the heat engine system 90, 200.

The process control system 204 may operate with the heat engine system 90, 200 semi-passively with the aid of several sets of sensors. The first set of sensors is arranged at or adjacent the suction inlet of the turbopump 260 and the start pump 280 and the second set of sensors is arranged at or adjacent the outlet of the turbopump 260 and the start pump 280. The first and second sets of sensors monitor and report the pressure, temperature, mass flowrate, or other properties of the working fluid within the low and high pressure sides of the working fluid circuit 202 adjacent the turbopump 260 and the start pump 280. The third set of sensors is arranged either inside or adjacent the mass control tank 286 to measure and report the pressure, temperature, mass flowrate, or other properties of the working fluid within the mass control tank 286. Additionally, an instrument air supply (not shown) may be coupled to sensors, devices, or other instruments within the heat engine system 90, 200 and/or the mass management system 270 that may utilized a gaseous source, such as nitrogen or air.

In some embodiments described herein, the waste heat system 100 may be disposed on or in a waste heat skid 102 fluidly coupled to the working fluid circuit 202, as well as other portions, sub-systems, or devices of the heat engine system 90, 200. The waste heat skid 102 may be fluidly coupled to a source of and an exhaust for the heat source stream 110, a main process skid 212, a power generation skid 222, and/or other portions, sub-systems, or devices of the heat engine system 200.

In one or more configurations, the waste heat system 100 disposed on or in the waste heat skid 102 generally contains inlets 122, 132, and 152 and outlets 124, 134, and 154 fluidly coupled to and in thermal communication with the working fluid within the working fluid circuit 202. The inlet 122 may be disposed upstream of the heat exchanger 120 and the outlet 124 may be disposed downstream of the heat exchanger 120. The working fluid circuit 202 may be configured to flow the working fluid from the inlet 122, through the heat exchanger 120, and to the outlet 124 while transferring thermal energy from the heat source stream 110 to the working fluid by the heat exchanger 120. The inlet 152 may be disposed upstream of the heat exchanger 150 and the outlet 154 may be disposed downstream of the heat exchanger 150. The working fluid circuit 202 may be configured to flow the working fluid from the inlet 152, through the heat exchanger 150, and to the outlet 154 while transferring thermal energy from the heat source stream 110 to the working fluid by the heat exchanger 150. The inlet 132 may be disposed upstream of the heat exchanger 130 and the outlet 134 may be disposed downstream of the heat exchanger 130. The working fluid circuit 202 may be configured to flow the working fluid from the inlet 132, through the heat exchanger 130, and to the outlet 134 while transferring thermal energy from the heat source stream 110 to the working fluid by the heat exchanger 130.

In one or more configurations, the power generation system 220 may be disposed on or in the power generation skid 222 generally contains inlets 225*a*, 225*b* and an outlet 227 fluidly coupled to and in thermal communication with the working fluid within the working fluid circuit 202. The inlets 225*a*, 225*b* are upstream of the power turbine 228 within the high pressure side of the working fluid circuit 202 and are configured to receive the heated and high pressure working fluid. In some examples, the inlet 225*a* may be fluidly coupled to the outlet 124 of the waste heat system 100 and may be configured to receive the working fluid flowing from the heat exchanger 120 and the inlet 225*b* may be fluidly coupled to the outlet 241 of the process system 210 and may be configured to receive the working fluid flowing from the turbopump 260 and/or the start pump 280. The outlet 227 may be disposed downstream of the power turbine 228 within the low pressure side of the working fluid circuit 202 and may be configured to provide the low pressure working fluid. In some examples, the outlet 227 may be fluidly coupled to the inlet 239 of the process system 210 and may be configured to flow the working fluid to the recuperator 216.

A filter 215*a* may be disposed along and in fluid communication with the fluid line at a point downstream of the heat exchanger 120 and upstream of the power turbine 228. In some examples, the filter 215*a* may be fluidly coupled to the working fluid circuit 202 between the outlet 124 of the waste heat system 100 and the inlet 225*a* of the process system 210.

The portion of the working fluid circuit 202 within the power generation system 220 is fed the working fluid by the inlets 225*a* and 225*b*. A power turbine stop valve 217 may be fluidly coupled to the working fluid circuit 202 between the inlet 225*a* and the power turbine 228. The power turbine stop valve 217 may be configured to control the working fluid flowing from the heat exchanger 120, through the inlet 225*a*, and into the power turbine 228 while in an opened-position. Alternatively, the power turbine stop valve 217 may be configured to cease the flow of working fluid from entering into the power turbine 228 while in a closed-position.

A power turbine attemperator valve 223 may be fluidly coupled to the working fluid circuit 202 via an attemperator bypass line 211 disposed between the outlet on the pump portion 262 of the turbopump 260 and the inlet on the power turbine 228 and/or disposed between the outlet on the pump portion 282 of the start pump 280 and the inlet on the power turbine 228. The attemperator bypass line 211 and the power turbine attemperator valve 223 may be configured to flow the working fluid from the pump portion 262 or 282, around and avoid the recuperator 216 and the heat exchangers 120 and 130, and to the power turbine 228, such as during a warm-up or cool-down step. The attemperator bypass line 211 and the power turbine attemperator valve 223 may be utilized to warm the working fluid with heat coming from the power turbine 228 while avoiding the thermal heat from the heat source stream 110 flowing through the heat exchangers, such as the heat exchangers 120 and 130. In some examples, the power turbine attemperator valve 223 may be fluidly coupled to the working fluid circuit 202 between the inlet 225*b* and the power turbine stop valve 217 upstream of a point on the fluid line that intersects the incoming stream from the inlet 225*a*. The power turbine attemperator valve 223 may be configured to control the working fluid flowing from the start pump 280 and/or the turbopump 260, through the inlet 225*b*, and to a power turbine stop valve 217, the power turbine bypass valve 219, and/or the power turbine 228.

The power turbine bypass valve 219 may be fluidly coupled to a turbine bypass line that extends from a point of the working fluid circuit 202 upstream of the power turbine stop valve 217 and downstream of the power turbine 228. Therefore, the bypass line and the power turbine bypass valve 219 are configured to direct the working fluid around and avoid the power turbine 228. If the power turbine stop valve 217 is in a closed-position, the power turbine bypass valve 219 may be configured to flow the working fluid around and avoid the power turbine 228 while in an opened-position. In one embodiment, the power turbine bypass valve 219 may be utilized while warming up the working fluid during a start-up operation of the electricity generating process. An outlet valve 221 may be fluidly coupled to the working fluid circuit 202 between the outlet on the power turbine 228 and the outlet 227 of the power generation system 220.

In one or more configurations, the process system 210 may be disposed on or in the main process skid 212 generally contains inlets 235, 239, and 255 and outlets 231, 237, 241, 251, and 253 fluidly coupled to and in thermal communication with the working fluid within the working fluid circuit 202. The inlet 235 may be disposed upstream of the recuperator 216 and the outlet 154 and downstream of the recuperator 216. The working fluid circuit 202 may be configured to flow the working fluid from the inlet 235, through the recuperator 216, and to the outlet 237 while transferring thermal energy from the working fluid in the low pressure side of the working fluid circuit 202 to the working fluid in the high pressure side of the working fluid circuit 202 by the recuperator 216. The outlet 241 of the process system 210 may be disposed downstream of the turbopump 260 and/or the start pump 280, upstream of the power turbine 228, and may be configured to provide a flow of the high pressure working fluid to the power generation system 220, such as to the power turbine 228. The inlet 239 may be disposed upstream of the recuperator 216, downstream of the power turbine 228, and may be configured to receive the low pressure working fluid flowing from the power generation system 220, such as to the power turbine 228. The outlet 251 of the process system 210 may be disposed downstream of the recuperator 218, upstream of the heat exchanger 150, and may be configured to provide a flow of working fluid to the heat exchanger 150. The inlet 255 may be disposed downstream of the heat exchanger 150, upstream of the drive turbine 264 of the turbopump 260, and may be configured to provide the heated high pressure working fluid flowing from the heat exchanger 150 to the drive turbine 264 of the turbopump 260. The outlet 253 of the process system 210 may be disposed downstream of the pump portion 262 of the turbopump 260 and/or the pump portion 282 of the start pump 280, may be coupled to a bypass line disposed downstream of the heat exchanger 150 and upstream of the drive turbine 264 of the turbopump 260, and may be configured to provide a flow of working fluid to the drive turbine 264 of the turbopump 260.

Additionally, a filter 215*c* may be disposed along and in fluid communication with the fluid line at a point downstream of the heat exchanger 150 and upstream of the drive turbine 264 of the turbopump 260. In some examples, the filter 215*c* may be fluidly coupled to the working fluid circuit 202 between the outlet 154 of the waste heat system 100 and the inlet 255 of the process system 210.

In another embodiment described herein, as illustrated in FIG. 2, the heat engine system 200 contains the process system 210 disposed on or in a main process skid 212, the power generation system 220 disposed on or in a power generation skid 222, the waste heat system 100 disposed on or in a waste heat skid 102. The working fluid circuit 202 extends throughout the inside, the outside, and between the main process skid 212, the power generation skid 222, the waste heat skid 102, as well as other systems and portions of the heat engine system 200. In some embodiments, the heat engine system 200 contains the heat exchanger bypass line 160 and the heat exchanger bypass valve 162 disposed between the waste heat skid 102 and the main process skid 212. A filter 215*b* may be disposed along and in fluid communication with the fluid line 135 at a point downstream of the heat exchanger 130 and upstream of the recuperator 216. In some examples, the filter 215*b* may be fluidly coupled to the working fluid circuit 202 between the outlet 134 of the waste heat system 100 and the inlet 235 of the process system 210.

It is to be understood that the present disclosure describes several exemplary embodiments for implementing different features, structures, or functions of the invention. Exemplary embodiments of components, arrangements, and configurations are described herein to simplify the present disclosure, however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the present disclosure may include embodiments in which the first and second features are formed in direct contact, and may also include embodiments in which additional features may be formed interposing the first and second features, such that the first and second features may not be in direct contact. Finally, the exemplary embodiments described herein may be combined in any combination of ways, i.e., any element from one exemplary embodiment may be used in any other exemplary embodiment without departing from the scope of the disclosure.

Additionally, certain terms are used throughout the present disclosure and claims for referring to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the present disclosure and in the claims, the terms "including," "containing," and "comprising" are used in an open-ended fashion, and thus should be interpreted to mean "including, but not limited to". All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The invention claimed is:

1. A heat engine system, comprising:

a working fluid circuit having a high pressure side and a low pressure side and containing a working fluid;

a heat exchanger fluidly coupled to and in thermal communication with the high pressure side of the working fluid circuit, configured to be fluidly coupled to and in thermal communication with a heat source stream, and configured to transfer thermal energy from the heat source stream to the working fluid within the high pressure side;

an expander fluidly coupled to the working fluid circuit, disposed between the high pressure side and the low pressure side, and configured to convert a pressure drop in the working fluid to mechanical energy;

a driveshaft coupled to the expander and configured to drive a device with the mechanical energy;

a start pump fluidly coupled to the working fluid circuit, disposed between the low pressure side and the high pressure side, and configured to circulate or pressurize the working fluid within the working fluid circuit;

a start pump bypass valve fluidly coupled to the working fluid circuit, disposed downstream of the start pump, and configured to control the flow of the working fluid flowing into the high pressure side from the start pump;

a turbopump fluidly coupled to the working fluid circuit, disposed between the low pressure side and the high pressure side, and configured to circulate or pressurize the working fluid within the working fluid circuit, wherein the turbopump contains a drive turbine coupled to and configured to drive a pump portion;

a turbopump bypass valve fluidly coupled to the working fluid circuit, disposed downstream of the pump portion of the turbopump, and configured to control the flow of the working fluid flowing into the high pressure side from the pump portion;

a drive turbine throttle valve fluidly coupled to the working fluid circuit, disposed upstream of the drive turbine, and configured to control the flow of the working fluid flowing into the drive turbine;

a recuperator fluidly coupled to the working fluid circuit and configured to transfer thermal energy from the working fluid within the low pressure side to the working fluid within the high pressure side;

a condenser in thermal communication with the working fluid circuit and configured to remove thermal energy from the working fluid in the low pressure side; and a process control system operatively connected to the working fluid circuit and configured to adjust the turbopump bypass valve and the start pump bypass valve while providing a turbopump discharge pressure at a greater value than a start pump discharge pressure.

2. The heat engine system of claim 1, further comprising a control algorithm contained within the process control system.

3. The heat engine system of claim 2, wherein the control algorithm is configured to calculate and adjust valve positions for the turbopump bypass valve and the start pump bypass valve for providing the turbopump discharge pressure at the greater value than the start pump discharge pressure.

4. The heat engine system of claim 1, further comprising a turbopump check valve disposed downstream of an outlet of the pump portion of the turbopump, wherein the turbopump check valve is configured to adjust from a closed-position to an opened-position at a predetermined pressure.

5. The heat engine system of claim 4, further comprising a start pump check valve disposed downstream of an outlet of a pump portion of the start pump, wherein the start pump check valve is configured to adjust from an opened-position to a closed-position at the predetermined pressure.

6. The heat engine system of claim 5, wherein the predetermined pressure is about 2,200 psig or greater.

7. The heat engine system of claim 1, further comprising:

an inventory supply line fluidly coupled to the low pressure side of the working fluid circuit and configured to transfer the working fluid into the working fluid circuit;

an inventory supply valve fluidly coupled to the inventory supply line and configured to control the flow of the working fluid flowing through the inventory supply line; and a transfer pump fluidly coupled to the inventory supply line, configured to pressurize the inventory supply line, and configured to flow the working fluid through the inventory supply line and into the working fluid circuit.

8. The heat engine system of claim 7, wherein the inventory supply line, the inventory supply valve, and the transfer pump are components within a mass management system fluidly coupled to the low pressure side of the working fluid circuit.

9. The heat engine system of claim 8, wherein the mass management system further comprises a mass control tank fluidly coupled to the low pressure side by the inventory supply line and configured to receive, store, and dispense the working fluid.

10. The heat engine system of claim 7, wherein the process control system is configured to pressurize a section of the inventory supply line with the transfer pump and configured to adjust the inventory supply valve and the drive turbine throttle valve for transferring the working fluid into the drive turbine.

11. The heat engine system of claim 1, wherein at least a portion of the working fluid circuit contains the working fluid in a supercritical state and the working fluid comprises carbon dioxide.

12. The heat engine system of claim 1, wherein the expander is a power turbine and the driveshaft is coupled to a power device configured to convert the mechanical energy into electrical energy, the power device is selected from a generator, an alternator, a motor, derivatives thereof, or combinations thereof.

13. A method for activating a turbopump within a heat engine system during a start-up process, comprising:

circulating a working fluid within a working fluid circuit, wherein the working fluid circuit has a high pressure side and a low pressure side;

transferring thermal energy from a heat source stream to the working fluid by at least one heat exchanger fluidly coupled to and in thermal communication with the high pressure side of the working fluid circuit;

pressurizing a section of an inventory supply line with a transfer pump while maintaining an inventory supply valve in a closed-position, wherein the inventory supply line is fluidly coupled to and between a storage tank and the working fluid circuit;

flowing the working fluid from the high pressure side into a drive turbine of the turbopump, wherein the working fluid has an inlet pressure measured near an inlet of the drive turbine;

flowing the working fluid from a pump portion of the turbopump into the high pressure side, wherein the working fluid as a turbopump discharge pressure measured near an outlet of the pump portion of the turbopump;

detecting a desirable pressure within the section of the inventory supply line and detecting the turbopump discharge pressure equal to or greater than the inlet pressure;

adjusting the inventory supply valve to an opened-position, providing a drive turbine throttle valve in an opened-position, and flowing the working fluid through the inventory supply line, through the working fluid circuit, and into the drive turbine, wherein the drive turbine throttle valve is fluidly coupled to the working fluid circuit upstream of the drive turbine; and increasing the turbopump discharge pressure during an acceleration process of the turbopump by:

switching a process controller for a turbopump bypass valve from an automatic mode setting to a manual mode setting;

switching a process controller for a start pump bypass valve from an automatic mode setting to a manual mode setting;

monitoring the turbopump discharge pressure via a process control system operatively connected to the working fluid circuit;

detecting an undesirable value of the turbopump discharge pressure via the process control system, wherein the undesirable value is less than a predetermined threshold value of the turbopump discharge pressure;

adjusting the turbopump bypass valve and the start pump bypass valve with the process control system to increase the turbopump discharge pressure;

detecting a desirable value of the turbopump discharge pressure via the process control system, wherein the desirable value is equal to or greater than the predetermined threshold value of the turbopump discharge pressure; and switching the process controllers for the turbopump bypass valve and start pump bypass valve from the manual mode settings to the automatic mode settings.

14. The method of claim 13, further comprising circulating the working fluid within the working fluid circuit by a start pump prior to adjusting the inventory supply valve to the opened-position.

15. The method of claim 14, wherein the turbopump discharge pressure is greater than a start pump discharge pressure.

16. The method of claim 15, further comprising opening a turbopump check valve and closing a start pump check valve, wherein the turbopump check valve is fluidly coupled to the working fluid circuit downstream of the pump portion of the turbopump and the start pump check valve is fluidly coupled to the working fluid circuit downstream of a pump portion of the start pump.

17. The method of claim 13, further comprising activating adaptive tuning on the process controller of the turbopump bypass valve to change response properties for maintaining a specified setpoint.

18. The method of claim 13, further comprising flowing the working fluid through a power turbine and converting the thermal energy into mechanical energy.

19. The method of claim 18, further comprising converting the mechanical energy into electrical energy by a power generator or alternator coupled to the power turbine.

20. The method of claim 13, wherein at least a portion of the working fluid is in a supercritical state and the storage tank is a mass control tank.

* * * * *